US005822650A

United States Patent [19]

Noda et al.

[11] Patent Number: 5,822,650

[45] Date of Patent: Oct. 13, 1998

[54] IMAGE FORMING APPARATUS

[75] Inventors: Akihiko Noda; Yoshiro Yamaguchi, both of Nakai-machi; Koichi Takashima, Minamiashigara; Suk Kim, Minamiashigara; Susumu Yoshino, Minamiashigara, all of Japan

[73] Assignee: Fuji Xerox Co., Ltd., Tokyo, Japan

[21] Appl. No.: 729,369

[22] Filed: Oct. 17, 1996

[30] Foreign Application Priority Data

Dec. 20, 1995 [JP] Japan ..... 7-332290

[51] Int. Cl.[6] ..... G03G 15/09

[52] U.S. Cl. ..... 399/53; 399/55

[58] Field of Search ..... 399/55, 53; 347/140

[56] References Cited

U.S. PATENT DOCUMENTS

| | | | |
|---|---|---|---|
| 4,999,272 | 3/1991 | Tanikawa et al. | 430/106.6 |
| 5,257,075 | 10/1993 | Ohki | 399/51 |
| 5,357,317 | 10/1994 | Fukuchi et al. | 399/39 |
| 5,574,545 | 11/1996 | Hosoi et al. | 399/270 |
| 5,610,696 | 3/1997 | Kemmochi et al. | 399/285 |

FOREIGN PATENT DOCUMENTS

| | | |
|---|---|---|
| 60-229033 | 11/1985 | Japan . |
| 61-130959 | 6/1986 | Japan . |
| 1-120566 | 5/1989 | Japan . |
| 5-19601 | 1/1993 | Japan . |

*Primary Examiner*—Nestor R. Ramirez
*Attorney, Agent, or Firm*—Oliff & Berridge, PLC

[57] ABSTRACT

An image forming apparatus performs a stable developing characteristic for an electrostatic latent image including a halftone image expressed by a binary manner. The apparatus includes a photoreceptor having a surface and an electrostatic image forming device for forming an electrostatic latent image on the surface of the photoreceptor, the electrostatic latent image including a digitally-reproduced binary latent image. The apparatus further includes a developing device for developing the electrostatic latent image. The developing device includes a two-component developer including magnetic carrier particles and toner particles. The apparatus also includes a bias applying device for applying a bias voltage between the developing device and the photoreceptor for defining a relatively high contrast potential of the digitally-reproduced binary latent image to be developed. The developing system includes a control system for controlling a certain amount of toner to be developed to be substantially constant corresponding to the contrast potential. Several configurations of the developing device may be adopted to the purpose.

9 Claims, 18 Drawing Sheets

*CONTRAST POTENTIAL DEFINED BY SURFACE POTENTIAL OF THE PHOTORECEPTOR AND DEVELOPING BIAS VOLTAGE*

IMAGE FORMING APPARATUS

BACKGROUND OF THE INVENTION

This invention relates to an image forming apparatus using a digital electrophotographic method for digital printers or digital copiers. More specifically, this invention relates to a digital xerographic apparatus in which a visible image is formed by uniformly charging a photoreceptor, exposing an intensity-modulated exposing light modulated corresponding to an image data including a halftone image expressed in a binary form for forming an electrostatic latent image onto the charged photoreceptor, and developing the electrostatic latent image.

The digital xerographic system has been widely utilized for digital printers or digital copiers.

In the digital xerographic system, typically, the photoreceptor is scanned by intensity-modulated, on-off modulated, exposure light corresponding to a digitized binary image data of original characters or pictures for producing an electrostatic image on the surface of the charged photoreceptor. Halftone images can also be formed by exposing an intensity modulated exposure light corresponding to a data expressed by halftone-dots or screen-dots onto the photoreceptor. The exposure light, which is typically a laser beam, is rapidly switched between on-state and off-state as a result of the modulating. Those image exposing techniques have been widely utilized for digital printers or digital copiers because of the ease of modulating algorithm or the good cost performance.

On the other hand, several kinds of two-component magnetic-brush developing systems have been utilized as a typical developing system for developing an electrostatic latent image in terms of stability of the triboelectric value of toner particles. In those two-component developing systems, a two-component developer containing magnetic carrier particles and toner particles is typically used.

The two-component developing system includes a developer holding member such as a developing roller positioned adjacent to the surface of the photoreceptor, the member holding the two-component developer on its surface. The two-component developer is transported to a developing nip located between the photoreceptor and the developing roller for developing the latent image formed on the photoreceptor. During the developing process, biased potential is applied between the photoreceptor and the developing roller, the biased potential is generally higher in absolute value than background potential of the photoreceptor. The contrast potential defined by the biased potential and an electrical potential at an imaged portion of the photoreceptor primarily defines the density of the toned image on the imaged portion. The total amount of the toner to be developed onto the photoreceptor increases linearly and theoretically as indicated in FIG. 1 corresponding to a magnitude of the contrast potential. However, once the sensitivity of the photoreceptor is changed due to environmental circumstances such as humidity or temperature or timely deterioration of the photoreceptor, the contrast potential might be changed enough to change the total amount of the toner particles to be developed. Thus, the halftone-image will not be accurately reproduced anymore in terms of its density.

In addition, the changing of the triboelectric magnitude of the toner particles also makes the reproduced toner image unstable in its density. For compensating the sensitivity changing of the photoreceptor, several process control techniques including a control of the magnitude of the developing bias or the magnitude of the exposing energy in response to the detected surface potential of the photoreceptor have been proposed. Those techniques may compensate the sensitivity changing as a whole of the photoreceptor, however, they might not compensate partial sensitivity deviation of the photoreceptor which are typically generated by partial deterioration of the photoreceptor or the thickness unevenness of the photoconductive layer generated during the production thereof.

It might preferably be adopted in a developing of digitized image comprises binary-level comprising a relatively high electric potential and a relatively low electric potential that a specific developing method indicating a saturated characteristic in its developing density corresponding to the contrast potential, as indicated in FIG. 2, rather than linear characteristic in its developing density, as indicated in FIG. 1. As understood from FIG. 2, in this case, regardless of the contrast potential, the total amount of the toner particles to be developed is always maintained constant at relatively high contrast potential area. Therefore, good reproducibility might be obtained through the method for the reproduction of the binary halftone image.

A typical developing system indicating such a saturated characteristic as FIG. 2 is well known as a one-component developing system.

The one-component developing system is categorized into two systems including a magnetic one-component developing system and a non-magnetic one-component developing system. The magnetic one-component developing system comprises a developing roller containing magnets therein and magnetic toner particles held on the surface of the developing roller. The magnetic toner particles are held onto the surface by the magnetic force between the magnets and the magnetic particles and are transported into the developing nip by rotating the developing roller. As the magnetic toner contains magnetic particles therein, the magnetic toner itself is not suitable for the purpose of color image development due to its low light transparency in use. On the other hand, the non-magnetic single-component developing system sometimes exhibit toner leaking or toner scattering from the developing system due to the non-magnetic characteristic of the toner. In addition, the single-component developing system typically has an image quality problem called "ghost defects". This image defect occurs when the toner particles on the developing image are once consumed partially corresponding to the latent image on the surface of the photoreceptor, then new toner particles are provided and refilled into the consumed portion on the surface of the developing roller. The new toner and the remaining toner on the developing roller indicate different behavior in the succeeding developing process respectively. This is due to differences in the triboelectric magnification, in average diameter of the toner particles, or in the residual potential between the portion where the new toner particles are added and the portion where the original toner is remaining. The differences also cause an unevenness of the toner amount to be developed onto the electrostatic latent image.

Several approaches have been proposed to eliminate such defects of the one-component developing system. One is to reduce a retaining force at the contacting point between the toner particles and the developing roller. For reducing the force, several surface structures of the developing roller or several discharging methods of the toner particles have been proposed. However, the "ghost defects" of one-component development system has not yet been solved completely in spite of such attempts. It has also been proposed to maintain the triboelectric magnification of the toner particle in relatively low magnification to reduce the force; however, the low triboelectric magnification of the toner particles also produces wrong sign toner, which will cause background fog. As an alternative approach to eliminate the "ghost defects", a method to retrieve the toner particles from the surface of the developing roller once after the development, then to re-apply new toner particles onto the surface of the developing roller has also been proposed. In this situation, as non-magnetic toner particles are adhered onto the surface of the developing roller by electrostatic force therebetween, the non-magnetic toner particles must be removed by means of mechanical force. This mechanical force sometimes provides a high stress to the toner particles and additives adhered onto the toner particles are removed from the toner particles or intruded thereon by the stress. These phenomena affect to charging ability and transfer ability of the toner particles.

Two-component developing system might eliminate "ghost defects" by removing the residual developer from the developing roller once after the development by removing the magnetic force therebetween; however, as mentioned above, the two-component developing system itself has a linear developing characteristic corresponding to the contrast potential of the photoreceptor. Therefore, a two-component developing system itself is still not suitable for the development of the digitized image having halftone image in a form of binary data. In addition, there have not useful proposals for neither how the developing characteristic of the two-component developing system will be saturated in a relatively wide range of the contrast potential nor how to use the developing system in the saturated area of the developing characteristic.

Japanese patent unexamined publication (JP-A) 61-130959 (1986) discloses a two-component developing system including toner particles and magnetic carrier particles, which indicates a developing characteristic as disclosed in FIG. 2. This publication discloses a specific carrier comprising phase-sintered ferrite particles having electric resistivity from $6.0\times10^4$ to $2.5\times10^6$ Ω, and a specific combination of the carrier particles and resistive toner particles for establishing a saturated developing characteristic at a relatively wide range of the contrast potential. However, this developing system was designed only for developing analogue electrostatic latent images including continuous changing of the surface potential. Therefore, the saturated area of the developing characteristic curve has not been applied to any actual developing process because, in a developing system for analogue electrostatic latent image, only the linear changing portion of the developing characteristic curve should be used in the developing process to ensure the reproduction of the halftone image. Otherwise, the image density of the developed image will always be a solid image regardless of the variety of the contrast potential characterized by the analogue image.

In addition, generally, it is not easy to control the triboelectric magnification of the toner particles in constant by using bare ferrite carrier particles. Therefore, toner particles themselves should have self-controllable triboelectric characteristics. However, designing the toner particles to have self-controllable triboelectric characteristics in addition to fusing or cleaning characteristics is not so easy. Additives added to the surface of the toner particle improve the triboelectric characteristic of the toner particle; however, it also sometimes induces pollution of the surface of the carrier particles due to the additives and reduces the triboelectric imparting characteristic thereof. Lifetime of the developer thus decreases.

To avoid such defects, it is well known to cover the surface of the ferrite carrier particle by a specific overcoating material such as resin material as disclosed in Japanese patent unexamined publication (JP-A) 1-120566 (1989). By choosing the overcoating material, it might be plausible to eliminate the pollution on the surface of the carrier particles by such additives and to control the triboelectric imparting characteristic of the carrier particle. However, due to the overcoating on the surface of the carrier particle, the carrier particle tends to indicate relatively high electric resistivity. Thus, the developing potential between the carrier particles and the photoreceptor will be reduced and the developing characteristic tends to be a linear characteristic at an actual range of the contrast potential for using actual developing. It is also plausible to saturate the developing characteristic at the actual range of the developing contrast by reducing the triboelectric magnification of the toner particles. However, such relatively low triboelectric magnification of the toner particles also produces many wrong-sign toner particles, which will induce much background fog.

Thus, the developing technique indicating such saturated developing characteristic for the digitized image including binary halftone-image with high durability and high stability has not yet been proposed.

SUMMARY OF THE INVENTION

This invention provides an image forming apparatus capable of finely and stably expressing a half tone image including a halftone image expressed by binary manner. The image forming apparatus performs a stable developing characteristic for an electrostatic latent image including a halftone image expressed by a binary manner. The apparatus comprises a photoreceptor having a surface, an electrostatic image forming device for forming an electrostatic latent image on the surface of the photoreceptor, the electrostatic latent image comprises a digitally-reproduced binary latent image, a developing device for developing the electrostatic latent image, the developing device including a two-component developer including magnetic carrier particles and toner particles, a bias applying device for applying a bias voltage between the developing device and the photoreceptor for defining a relatively high contrast potential of the digitally-reproduced binary latent image to be developed, and the developing system including a control system for controlling a certain amount of toner to be developed to be substantially constant corresponding to the contrast potential. Several configurations of the developing device may be adopted to the purpose.

DESCRIPTION OF THE PREFERRED EMBODIMENT

Figure 1:
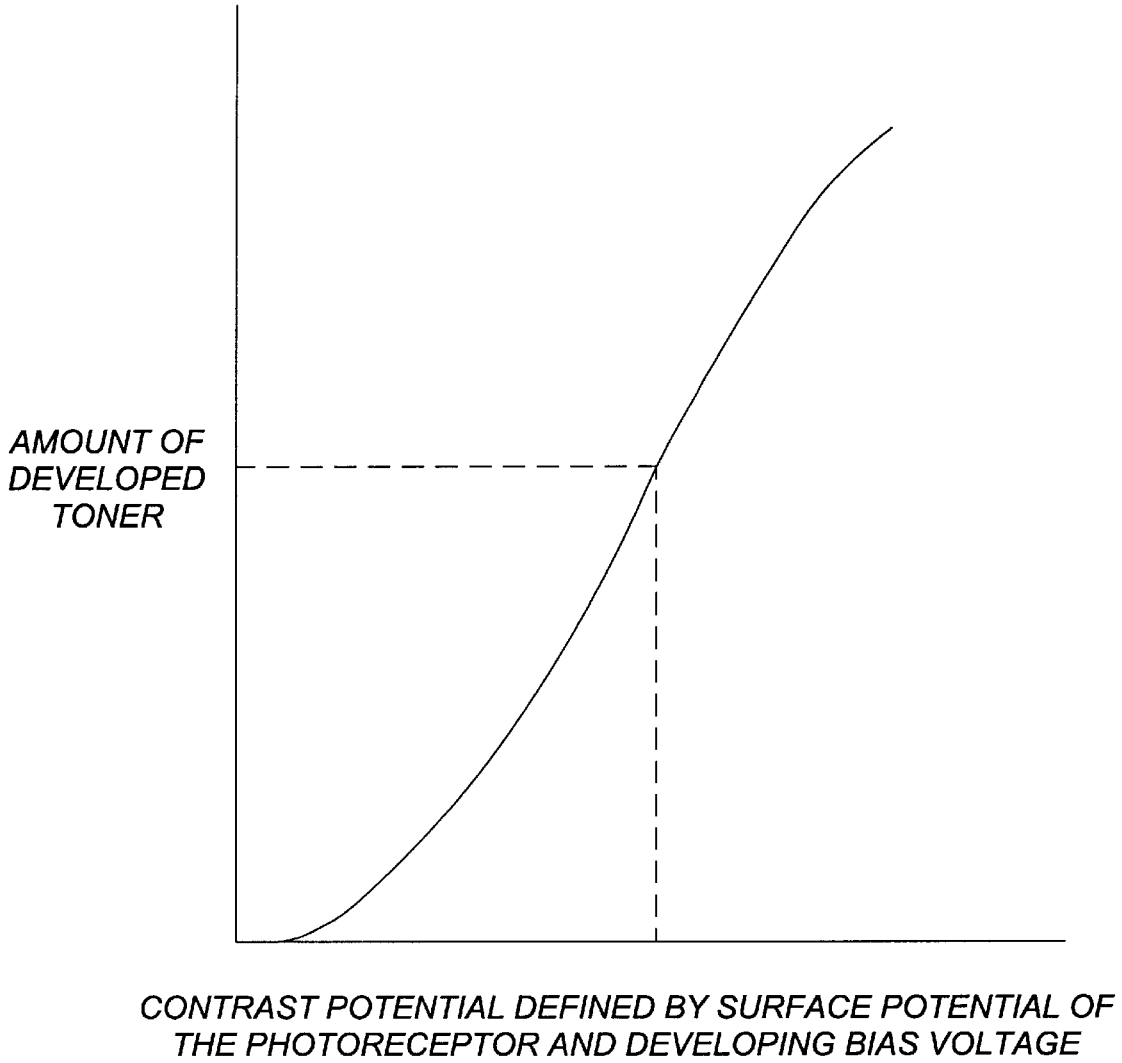
FIG. 1 is a graph showing the relationship between the developed toner weight and the contrast potential.
Figure 2:
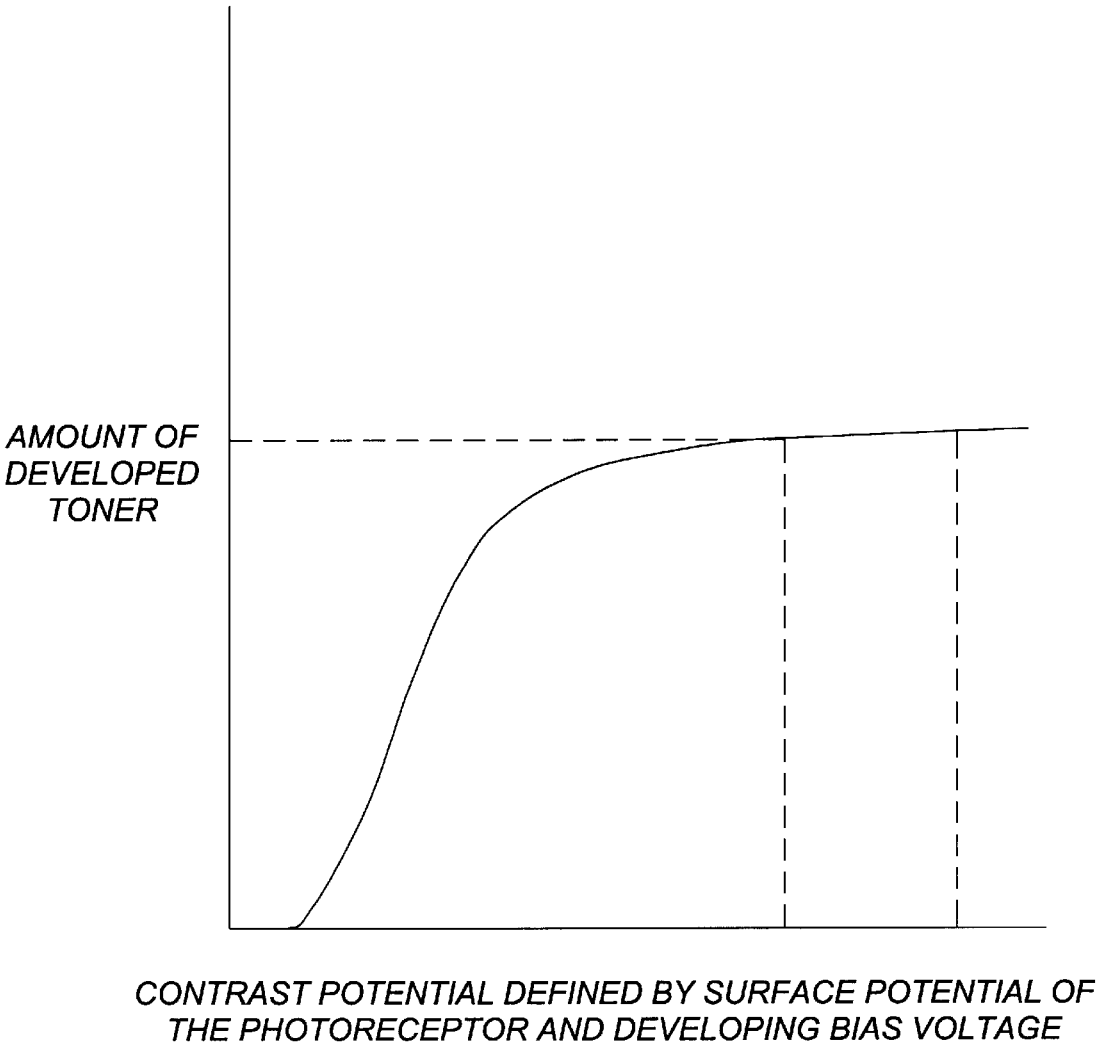
FIG. 2 is an another graph showing the relationship between the developed toner weight and the contrast potential.

In this invention, the "digitized image" expressed by the binary manner is defined as the image satisfying the following equation.

$$|V_{DC}-V_o|\approx|V_{DC}-V_i|$$

wherein, $V_{DC}$ is the bias voltage for developing, $V_o$ is the surface potential to be developed of either an exposed portion ($V_a$) or a non-exposed portion ($V_b$) at the photoreceptor surface when the surface potential is generated by exposing the 50 percentage-area exposing light for each imaging pixel, $V_i$ is the surface potential to be developed of either an exposed portion ($V_L$) or as non-exposed portion ($V_H$) at the photoreceptor surface when the surface potential is generated by exposing the 100 percentage-area exposing light for each imaging pixel.

In this invention, a stable halftone image reproduction to the digitized image will be performed by adopting the two-component developing system having saturated characteristic to the digitized electrostatic image regardless of the sensitivity changing and unevenness of the photoreceptor or triboelectric property changing due to the changing of environmental circumstances without any toner scattering or toner leaking problems from the developing apparatus.

The magnetic carrier particles having a volume resistivity of from $10^3$ to $10^8$ Ωcm is preferably used as the developer of the developing apparatus for the present invention. More preferably, the magnetic carrier contains magnetic particles, resin material and electric conductors. Most preferably the magnetic carrier particles comprise a magnetic core and an overcoating layer that is formed on the magnetic core and containing a resin material and conductive particles dispersed therein.

The developing bias voltage to be applied to the developing roller (developer holding member) is preferably a DC voltage within a saturated area of the developing curve superimposed with an AC voltage having from 100 V to 500 V peak to peak voltage($V_{p-p}$) and from 400 Hz to 20 KHz frequency.

The developing roller (developer holding member) preferably comprises a rotatable hollow cylindrical body for holding the two-component developer thereon and a plurality of magnets fixed and arranged along with the circumference direction within the hollow cylindrical body. In this case, magnetic poles of each of the magnets are arranged alternatively about those polarities such as N, S, N, S . . . In this case, magnetic carrier particles having less than 40 μm volume diameter are preferably used, more preferably, magnetic carrier particles having from 10 μm to 40 μm volume diameter are used.

Alternatively, the developing roller preferably comprises a rotatable hollow cylindrical body for holding the developer thereon and a plurality of magnets fixed and arranged along with the circumference direction within the cylindrical body so that a developing nip is located between two magnetic poles, each of which has a unique magnetic polarity. The developing nip is defined as the closest portion between the developing roller and the photoreceptor. In this case, magnetic carrier particles having less than 60 μm volume diameter are preferably used, more preferably, the magnetic carrier particles having from 10 μm to 60 μm volume diameter are used. Otherwise, if the magnetic carrier has a magnetizing of 45 emu/g at a magnetic field of 400 Ös, the volume diameter of the magnetic carrier may preferably be less than 90 μm, more preferably from 10 μm to 90 μm.

Preferably, the developer on the developing roller surface is relatively moved to the same direction with that of the photoreceptor at the developing nip portion at a speed ratio of from 0.8 to 1.8 to the photoreceptor.

Figure 3A:
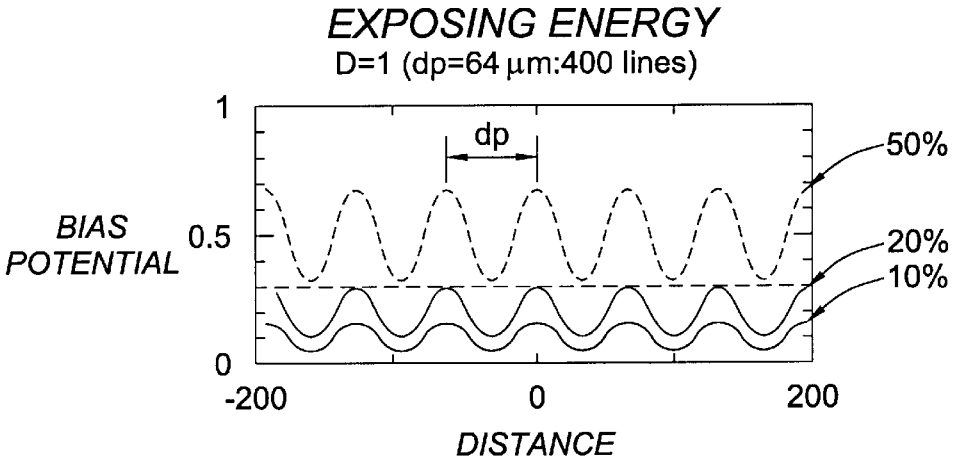
FIGS. 3(*a*), (*b*) and (*c*) are graphs showing an energy profile of exposing light on the surface of the photoreceptor varied by spot diameter of the exposing light.
Figure 3B:
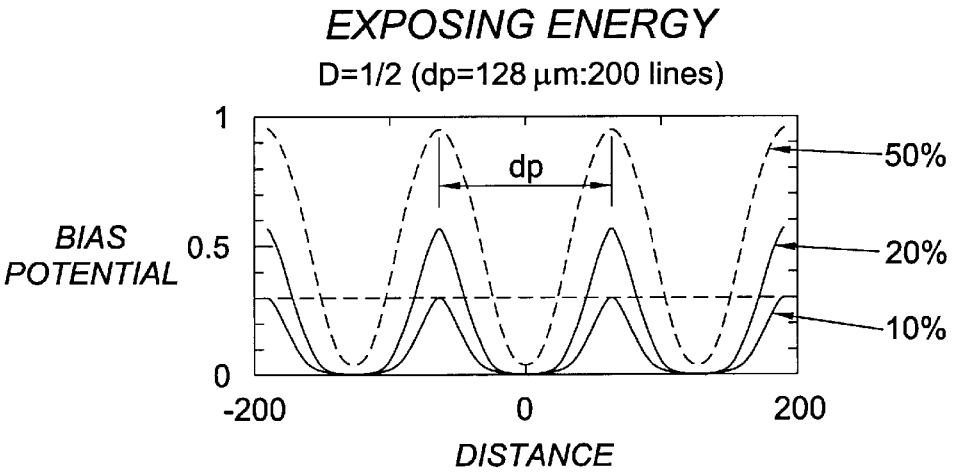
Figure 3C:
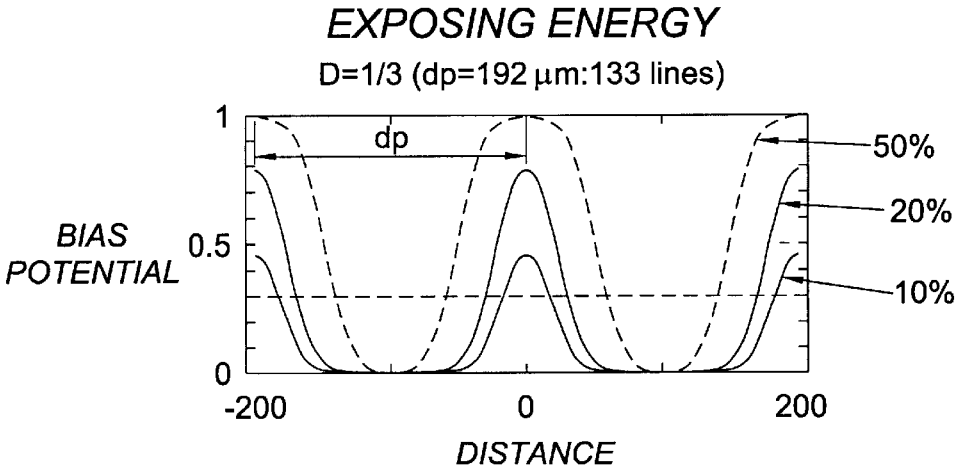
Figure 4A:
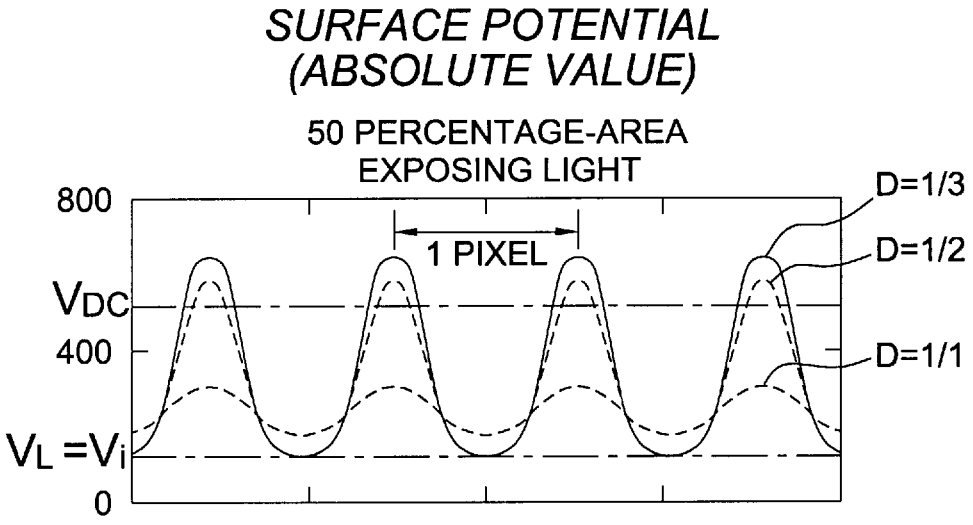
FIGS. 4(*a*) and (*b*) are both graphs showing an energy profile of the surface potential of the photoreceptor varied by spot diameter of the exposing light.
Figure 4B:
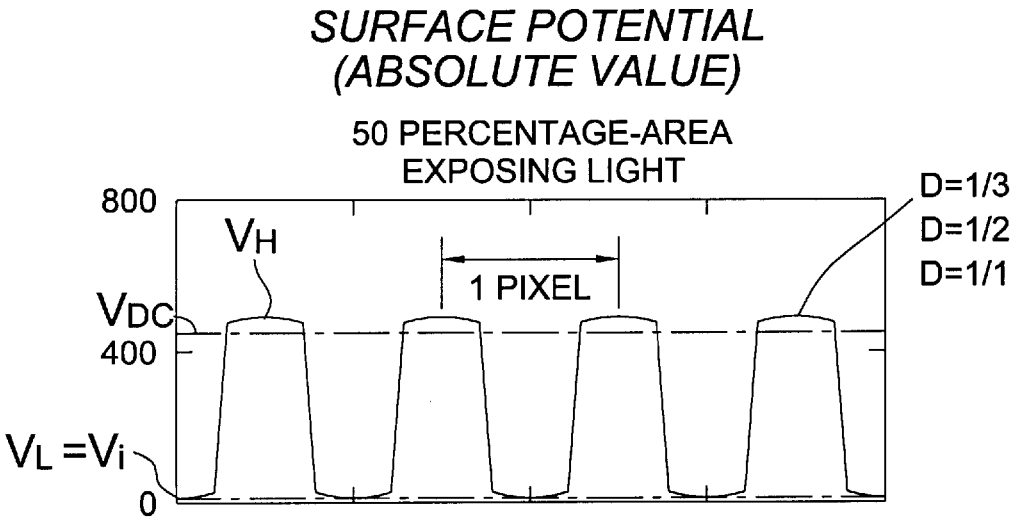
Figure 5A:
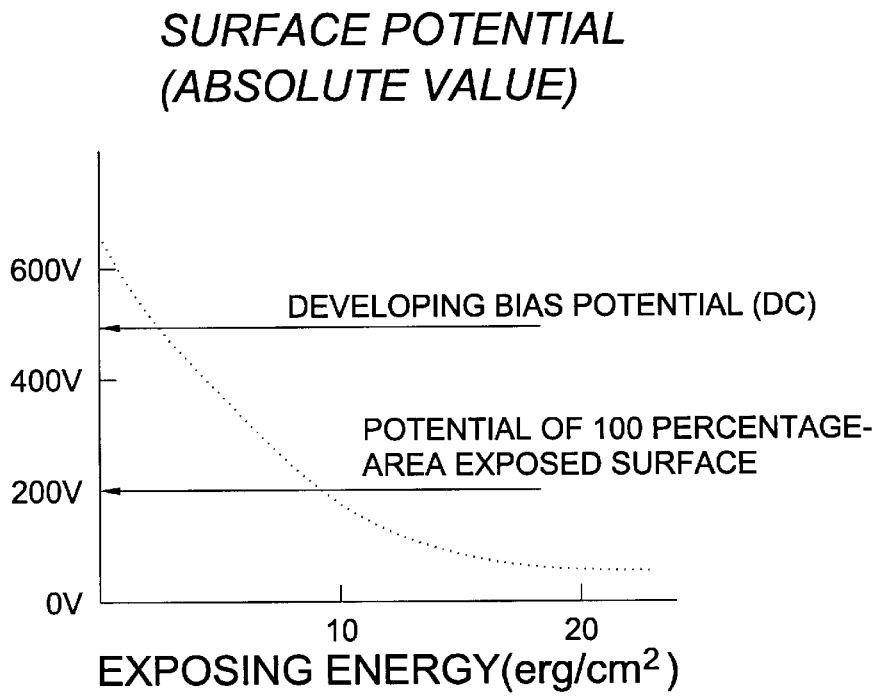
FIGS. 5(*a*) and (*b*) are both graphs showing decaying profile of the surface potential of the photoreceptor.
Figure 5B:
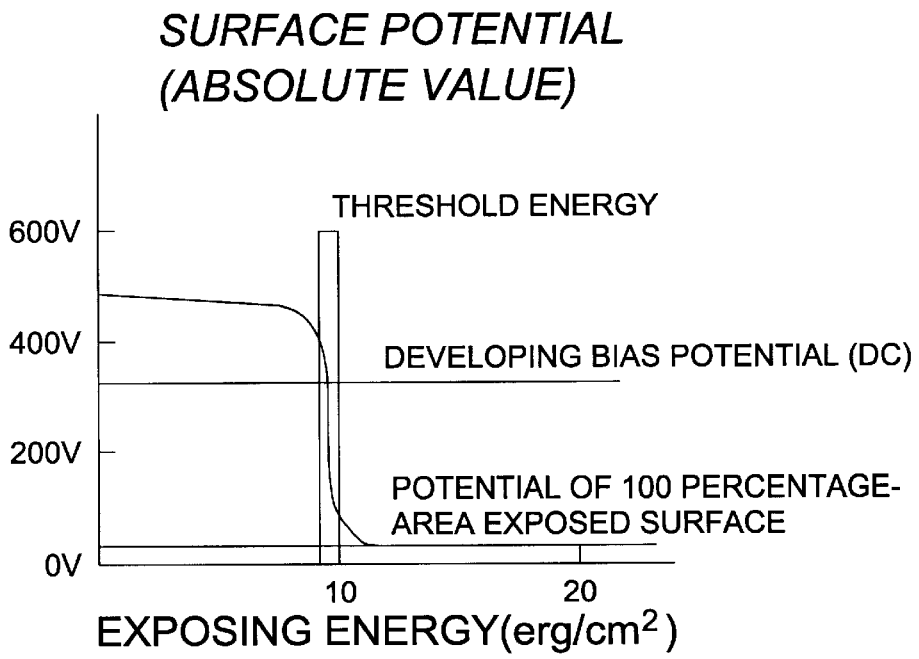

FIG. 3 shows energy profiles of the exposing light when the photoreceptor is exposed by the light with 10% exposing area, 20% exposing area and 50% exposing area for each pixel, respectively. FIGS. 3(*a*), 3(*b*) and 3(*c*) respectively indicates an energy profile when D is 1/1, 1/2 and 1/3 respectively, wherein D is defined by the equation dB/dP=D, where dB is the laser spot diameter, which is constant and dP (mm) is the distance between adjacent pixels, which is varied respectively in the equation, As disclosed in FIG. 3, the contrast of the energy profile by the exposing light is decreased to be an analogue-like profile along with the increasing of the value of D for 1/3, 1/2 and 1/1. FIG. 4(*a*) is the surface potential changing profile when the photoreceptor having the decaying profile as shown in FIG. 5(*a*) is exposed by the exposing light of 50 percentage area exposing for each pixel. The surface potential profile is calculated by a known method disclosed in "Proceedings IS & T's 9th International Congress on Advances in Non-Impact Printing Technologies", Vol. 9, pp97–100, 1993.

As indicated by FIG. 4(*a*), both the contrast of the energy profile of the exposing light and the contrast of the profile of the surface potential of the latent image are decreased along with the increasing of the magnification of D. According to the definition of the "digitized image", the digitized latent static image will be obtained by setting the value of D not more than 1/2 as indicated in FIG. 4(*a*) providing the photoreceptor has the decaying profile as indicated in FIG. 5(*a*).

In addition, as indicated in FIG. 4(*b*), the digitized electrostatic latent image can also be obtained by tuning the value of the exposing energy even when the value of D is 1, providing the photoreceptor has the decaying profile as indicated in FIG. 5(*a*). By setting the developing bias voltage of the developing system so that the amount of the developer will be saturated corresponding to the contrast potential of the digitized electrostatic latent image, reproduction of the digitized image will be stably and finely ensured by the stable amount of the developed toner even when the photoreceptor has an uneven sensitivity surface.

To obtain a developing system having saturated characteristic, stability and durability, the two-component magnetic-brush developing system including carrier particles having a volume resitivity of not more than $10^8$ Ωcm is the most preferred configuration in this invention. The developing toner amount will not tend to be saturated if other high resistive carrier particles are used for the developing apparatus because it reduces the developing field to sufficiently slow the rising of the developing profile curve. In addition, the high-resistive carrier produces an internal potential which tends to transfer not only outer toner particles of the developing layer but also internal toner particles of the developing layer sufficient to substantially increase the developing toner gradually (i.e. not saturated).

On the other hand, the developing toner amount will tend to be saturated if relatively low-resistive carrier particles are used for the developing apparatus because it allows the relatively strong developing field to increase the rising of the developing profile curve. In addition, the low resistive carrier does not produce the internal potential, therefore, immediately after the toner particles on the surface of the developing layer are transferred onto the surface of the photoreceptor, the developing toner amount will be not be increased anymore (i.e. saturated).

If the volume resistivity of the magnetic carrier particle is much lower, the magnetic carrier particles tend to be transferred onto the surface of the photoreceptor to cause image defects on the toned image called "white spots". Therefore, preferably, the volume resistivity of the magnetic carrier particle is not less than $10^3$ Ωcm. If the magnetizing of the magnetic carrier is less than 10 emu/g at 400 Ös magnetic field, the "white spots" will occur frequently due to the carrier transferring to the photoreceptor from the developing roller, therefore, preferably, the magnetizing of the magnetic carrier particle is not less than 10 emu/g at 400 Ös magnetic field.

If the volume average diameter of the magnetic carrier is less than 10 μm, sometimes the scattering of the developer from the developing apparatus will occur. If the volume average diameter of the magnetic carrier is more than 100 μm, sometimes only the low image density is obtained. Therefore, preferably, the volume average diameter of the magnetic carrier particle is from 10 to 100 μm, Thus, the toner concentration of the developer is controlled so that the developed amount of the toner particles is always saturated during the developing operation corresponding to the contrast potential defined by the developing bias voltage applied to the developing roller and the surface potential of imaged portion of the photoreceptor.

As preferably the magnetic carrier particles comprise the magnetic core and the overcoating material including an electrically insulative resin material and the conductive particles dispersed therein, the magnetic carrier particles maintain their relatively low electric resistivity. Thus, the developed amount of the toner particles corresponding to the contrast potential will be maintained at the saturated state in actual developing condition. In addition, if the magnetic carrier includes an overcoating layer such as fluorinated resin material or silicone-type resin material, the raising characteristic of the developing curve and triboelectric magnification of the developer during the developing process will be maintained for a long time. The overcoating layer also prevents surface pollution thereof due to additives transferred from the surface of the toner particle because the overcoating materials are gradually abraded by friction force between carrier particles and toner particles. Several conductive paths will be produced by the conductive particles dispersed in the overcoating layer to maintain electrical resistivity of the carrier particles constant regardless of the abrasion.

Figure 17:
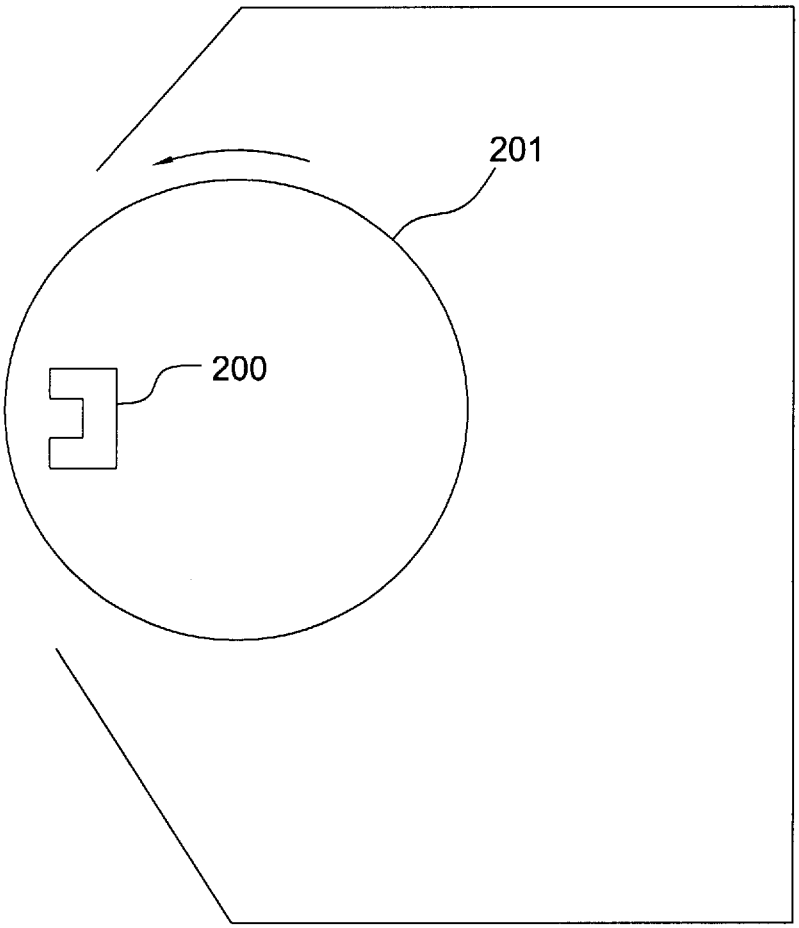
FIG. 17 is a schematic view of a developing apparatus utilizing repulsive arrangement of the developing magnets in a developing sleeve.
Figure 18:
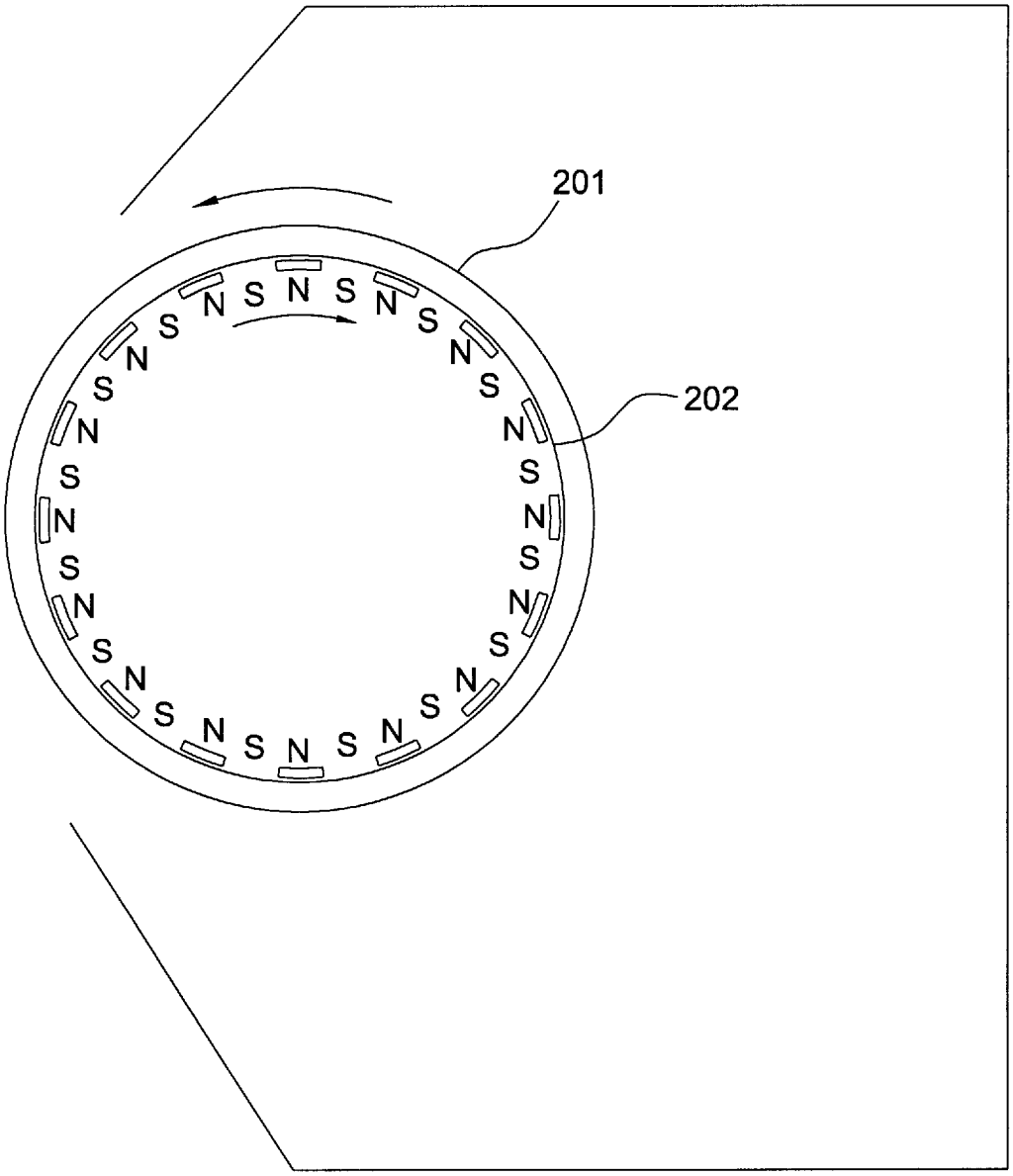
FIG. 18 is a schematic view of a developing apparatus utilizing a rotatable developing magnet structure in a developing sleeve.

An alternative system is also proposed hereinafter for performing the saturated characteristic of the developing toner. The developing system comprises a rotatable cylinder, developer including magnetic carrier particles and toner particles formed on the rotatable cylinder and a magnet fixed within the rotatable sleeve, wherein the magnetic carrier particles have relatively small average diameter. In this system, magnetic carrier particles having a volume average diameter not more than 40 μm are preferably used. As the developing bias, both AC and DC voltage can be applied without any changing of the saturated developing characteristic. If a steel carrier bead is used as the carrier particle, or if the inter-magnetic pole developing system is used for the developing system, the saturated developing characteristic of the developer will be much enhanced. The inter-magnetic pole developing system means that the developing system includes a gap between adjacent magnets placed within the developing sleeve located at the developing nip, wherein a perpendicular line against the developing roller surface at the developing nip is shifted from the magnetic line in force generated from any magnetic poles. If carrier particles having relatively small average diameter are used, carrier-particle chains formed on the surface of the developing roller by magnetic force between the magnetic carrier particles and the magnets tend to be packed tightly on the developing roller by incorporating many carrier particles therein as much with the narrowing of gaps among carrier particles, and then the transfer of the toner particles from the inside of the packed carrier-particle chains will be prohibited. Also, as the steel carrier bead itself has much higher magnetising than that of the ferrite carrier particles, the packing effect to prohibit the transferring of the toner will be much enhanced. When the inter-magnetic pole developing system is used, the carrier particle chains tend to be bedded on the surface of the developing sleeve along with existing magnetic fields between adjacent magnets and reduce gaps among the carrier particles. This feature also enhances the saturated characteristic of the developing apparatus. If the aforementioned carrier particle having relatively low electric resistivity are used for this developing system, the saturated characteristic will also be enhanced. When the inter-magnetic developing system is utilized, as the magnetic line in force will be far from the perpendicular line to the surface of the developing roller, the saturated characteristic of the developing is also enhanced. However, if the repulsive arrangement of the developing magnets 200 in a developing sleeve 201, as disclosed in FIG. 17, or the rotating arrangement of the inner magnets 202, as disclosed in FIG. 18, is utilized in this developing system, sometimes the saturated characteristic of the developing system will no longer be performed.

Figure 6:
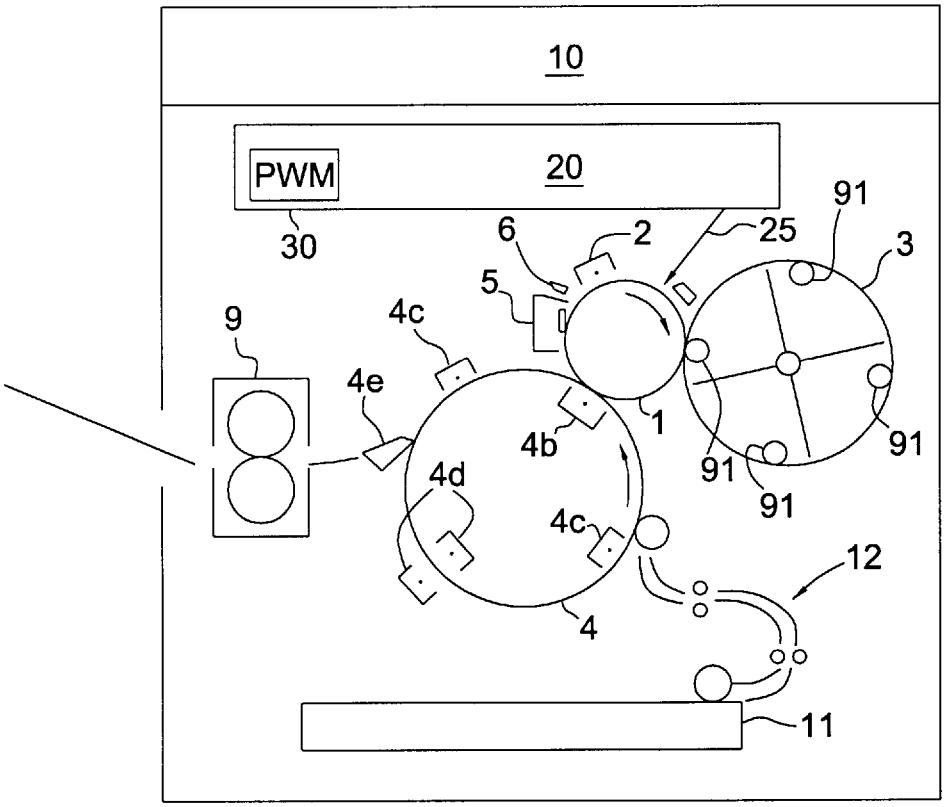
FIG. 6 is a schematic view of the color copier adopting one embodiment of the present invention.

FIG. 6 is a schematic view of a color image forming apparatus utilizing one embodiment of the present invention. The original document is placed onto the upper portion of the image reading system10 with the image on the original document downwardly and the image signal is generated by reading the image photoelectrically by the image reading system10.

The beam scanning system 20 generates On-Off modulated light beam 25 corresponding to the generated image signal and scans the modulated light beam onto the surface of the photoconductive drum 1, which rotates in the arrow direction as indicated in FIG. 6, periodically in a fast-scan direction which is perpendicular to the arrow direction. Beforehand, the photoconductive drum is uniformly charged by the charger 2. The light beam 25 is modulated into On-Off state by the pulse-width modulating circuit 30 in response to the generated image signal. The surface of the photoconductive drum is scanned by the modulated light beam 25 to generate an electrostatic latent image. The electrostatic image on the photoconductive drum is moved to the developing nip adjacent to the rotatable developing apparatus 3. The rotatable developing apparatus 3 comprises four independent developing apparatuses each of which includes yellow toner, cyan toner, magenta toner and black toner, respectively. In this case, each developing apparatus is configured as a two-component magnetic-brush developing system. The average diameter of the toner particles is 7 $\mu$m. The rotatable developing apparatus rotates periodically for developing all electrostatic latent images each of which corresponding to one of the colored toner particles. A developing bias voltage is applied to the developing sleeve 91 of each developing apparatus.

Then the developed image is moved to the transferring station which is opposed to the transferring drum 4 by rotating the photoconductive drum 1. A recording paper (not shown) moved from the paper cassette tray 11 via predetermined paper transporting path 12 is attracted electrostatically onto the circumference of the transferring drum 4 by the charger 4*a* and transported to the transferring station by the rotation of the transferring drum 4 in the arrow direction. Then, the toner image formed on the surface of the photoconductive drum is transferred onto the recording paper, which is held on the surface of the transferring drum 4 by the transferring charger 4*b* at the transferring station.

The surface of the photoconductive drum is cleaned by the cleaner 5 to remove residual toner particles, exposed by the pre-exposing lamp to erase the residual surface potential and re-charged uniformly by the charger 2 for the succeeding image forming process. The recording paper is maintained on the surface of the transferring drum 4 during the successive transferring steps of yellow, cyan, magenta and black toners onto the recording paper by the rotation of the transferring drum. The transferring portion of each toner image on the recording paper is timingly adjusted at each transferring step using the transferring drum 4 for transferring each toner image so that all toner images are overlapped on the recording paper successively in correct registration.

Then, the recording paper, after all the transferring processes are finished, is detached from the surface of the transferring drum 4 by eliminating any electrostatic attractive force therebetween by the detach charger 4*c* and detaching fingers 4*e*. The toner image on the recording paper is fixed onto the recording paper by fuser 9 and stacked at the outside of the image forming apparatus. The surface of the transferring drum 4 is then discharged by the discharger 4*d* and if necessary, a succeeding recording paper is attracted thereon by the same manner.

Figure 7:
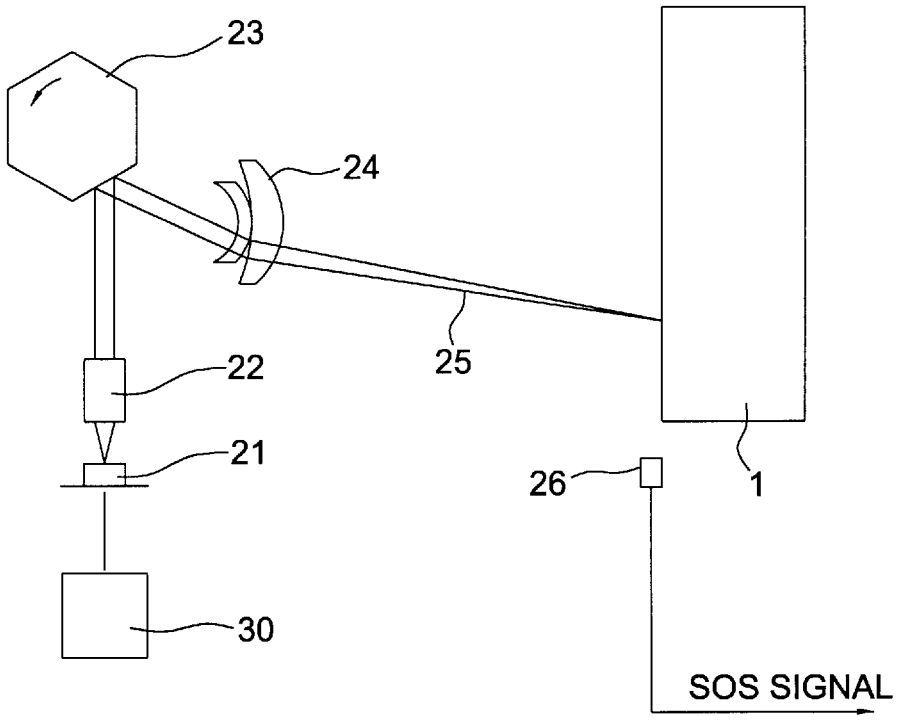
FIG. 7 is a detailed structure of the raster scanning outputting mechanism of the color copier indicated in FIG. 6.

FIG. 7 is a schematic view of the beam scanning system. The laser beam modulated by the pulse-width modulating circuit 30 is emitted from the semiconductive laser device 21, is collimated by the collimator lens 22, is reflected periodically by the polygonal mirror 23 rotating in an arrow direction, is transmitting through the fθ lens 24 for adjusting the spot diameter of the laser beam on the surface of the photoconductive drum and is finally scanning the surface of the photoconductive drum periodically in the slow-scan direction (up and down direction of FIG. 7). At the beginning of each scan, the laser beam is detected by the sensor 26 to generate Start of Scan Signal (SOS) which will be incorporated into a control unit (not shown) for controlling the timing of the rotation of the photoconductive drum or the polygonal mirror.

Figure 8:
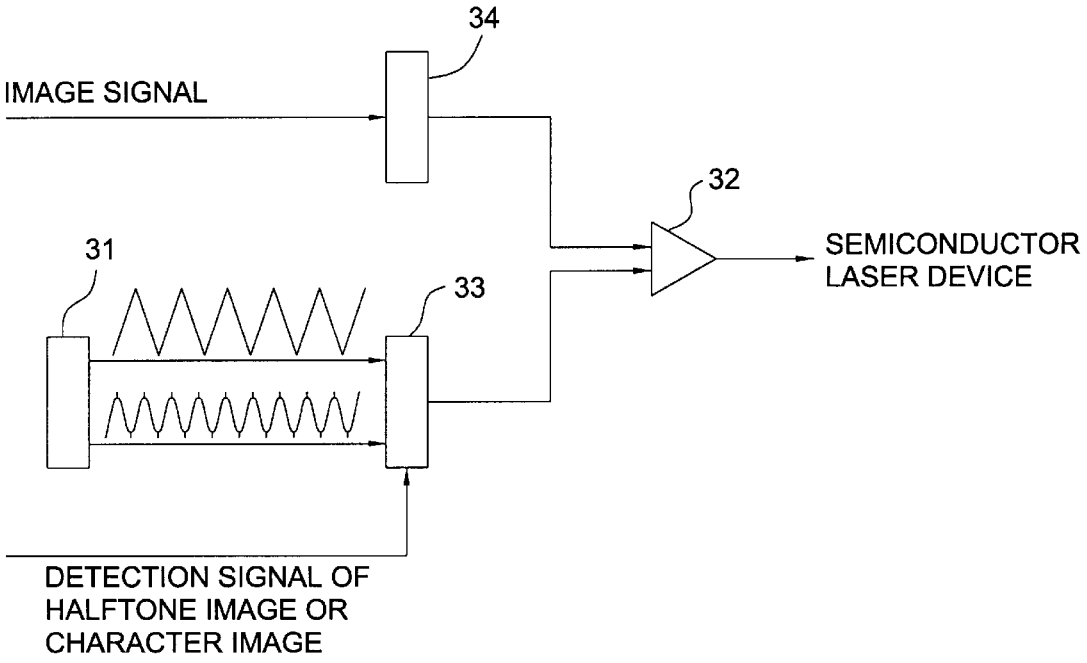
FIG. 8 is a block diagram of the pulse-width modulating circuit for exposing laser light.

FIG. 8 is the a diagram of the pulse-width modulating circuit for modulating the laser beam. The pulse generator 31 generates two kinds of triangular-pulse waves each of which has a unique alternate frequency as indicated in FIG. 8. The triangular pulses are inputted into the selector 33. The selector 33 selects either a high-frequency triangular pulse, which is suitable for halftone image reproducing or a low-frequency triangular pulse, which is suitable for character image reproducing, based on a designating signal which designates either the halftone image producing mode or a character image producing mode of the image forming apparatus, the signal is inputted by an operator at the image reading system 10 (shown in FIG. 6). The selected triangular signal is inputted into the comparator 32. On the other hand, the image signal (digital signal) generated by the image reading system 10 is inputted into the D/A converter 34, and converted into an analogue signal and finally inputted into the comparator 32. The comparator 32 compares the level of the analogue signal and the level of the inputted triangular pulse, then converts the analogue signal into the sequence of the two-digit signal in which each pulse has a unique width corresponding to the level of the analogue signal. The semiconductor laser device 21 receives the sequence of the two-digit signal and generates the pulse-width modulated signal corresponding to the sequence of the two-digit signal.

Figure 9:
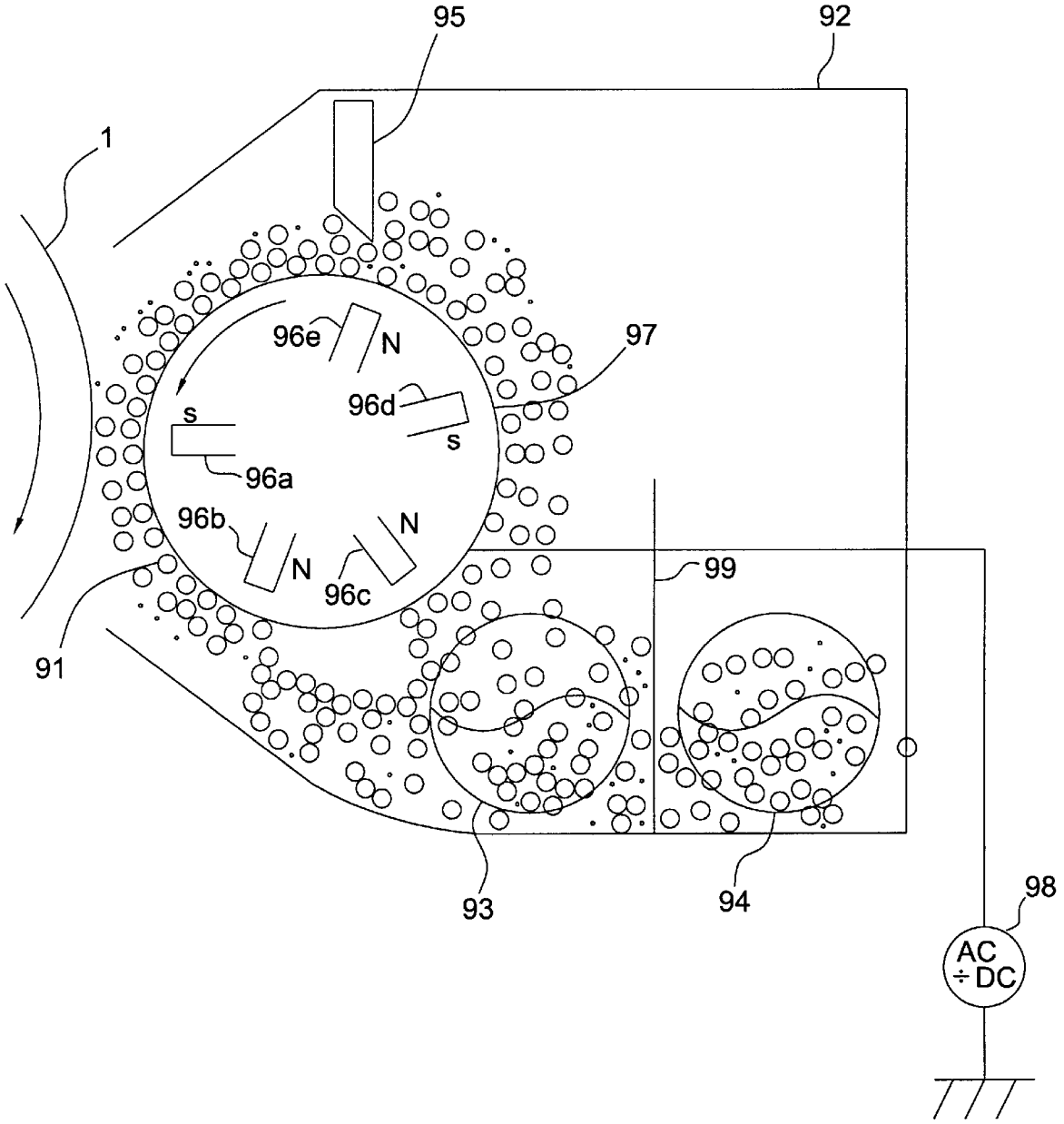
FIG. 9 is a detailed structure of one of the four developing apparatus constituting the rotatable developing station as disclosed in FIG. 6.

FIG. 9 is the schematic view of one of the four developing apparatuses which constitute the rotatable developing apparatus as indicated in FIG. 6. The developing apparatus comprises developing container 92 and the developing roller 91 rotatably mounted therein. The developing roller comprises a rotatable cylinder 97 and several magnets 96*a*, 96*b* . . . and 96*e* which are fixed in the sleeve. The developer containing magnetic carrier particles and toner particles is attracted onto the surface of the developing roller and is configured to produce a magnetic brush by the magnetic force generated by magnets. The magnetic brush is transported to the developing nip according to the rotating of the cylinder 97 (arrow direction). The magnetic brush frictionally contact to the electrostatic latent image formed on the photoconductive surface at the opening portion of the container 92 to perform the development. The developer is further transported into the downstream of the cylinder 97 adjacent to the developing nip. Both of the fixed magnets 96*b* and 96*c* have same polarity to reduce the attractive force therebetween, thus, the developer on the developing roller is removed at this position. The removed developer is mixed and transported through the movement of the screw auger 93 and 94. The screw auger 93 and 94 transport the removed developer to both directions perpendicular to the plane of this figure within the container 92. During the transportation, new toner is added into the container through the opening formed at the end of the separating wall member 99 (not shown). The fixed magnet 96*c* picks-up new developer onto the developing roller 91. The picked developer is transported along with the rotation of the cylinder 97 and is restricted in its layer thickness by the metering member 95 frictionally contacting thereto. DC bias voltage overlapped with AC bias voltage is also applied to the developing roller 91 during the developing process.

Actual working examples and comparative examples will be explained in detail hereinafter for better understanding of the present invention.

Carrier Particles

The carrier particle used for the following example is overcoated with the resin (containing carbon black). When required, an appropriate carbon black should be chosen from the various kind of commercially available carbon blacks in terms of good matching with the resin material and electrical resistivity. The amount of the carbon black to be added to the resin material is determined based on the required resistivity for the coating layer and electrical resistivity thereof. If the load of the carbon black in the coating resin will be increased in order to obtain an appropriate electrical resistivity, a relatively high oil-absorptive carbon black is preferably used. When the high oil-absorptive carbon black is dispersed into the resin material, carbon black particles tend to strongly coagulate with each other enough to configure relatively tight conductive path therein. Thus, a relatively low load amount of the carbon black within the coating material will be realized by using the relatively high oil-absorptive carbon black.

One or several kinds of carbon black may be added into the coating layer. To coat the magnetic core particle with the coating material, several coating methods such as a powder coating method or a liquid coating method using a solvent may be appropriately used.

Preparation of the carrier particles

Preparation for carrier A (Average volume resistivity:$10^{11}$ Ωcm)

The coating solution was prepared by mixing the following materials in a homo-mixer for ten minutes:

| | |
|---|---|
| Toluene | 14 parts |
| Styrene-methylmethacrylate copolymer (Copolymerization ratio 20:80) | 1 part |

Then the prepared coating solution was mixed with 100 parts of the ferrite carrier particles (average volume diameter:50 μm) in the vacuum-deaerative coating apparatus at 60° C. for 30 minutes. The toluene was evaporated to produce the coating layer on the surface of the carrier particle. The carrier indicated $10^{11}$ Ωcm average volume resistivity.

Preparation for carrier B (Average volume resistivity:$10^{9}$ Ωcm)

The coating solution was prepared by mixing the following materials in a homo-mixer for ten minutes:

| | |
|---|---|
| Toluene | 14 parts |
| Styrene-methylmethacrylate copolymer (Copolymerization ratio 20:80) | 1 part |

Carbon Black (Monarch 800; Cabot corp.) The oil absorption is about 75 ml/100 g according to the catalogue data 5 volume percent to the copolymer.

Then the prepared coating solution was mixed with 100 parts of the ferrite carrier particles (average volume diameter:50 μm) in the vacuum-deaerative coating apparatus at 60° C. for 30 minutes. The toluene was evaporated to produce the coating layer on the surface of the carrier particle. The carrier indicated $10^{9}$ Ωcm average volume resistivity. (Carrier B)

Preparation for carrier C (Average volume resistivity:$10^{7}$ Ωcm)

The coating solution was prepared by mixing the following materials in a homo-mixer for ten minutes:

| | |
|---|---|
| Toluene | 14 parts |
| Dimethylaminoethylmethacrylate-styrene-methylmethacrylate copolymer (Copolymerization ratio: 4:20:76) | 1 part |
| Perfluorooctylmethacrylate-methylmethacrylate copolymer (Copolymerization ratio 40:60) | 2 parts |
| Carbon black(Vulcan XC-72; Cabot corp.) | |

10 volume percent to the total amount of the mixed copolymer

Then the prepared coating solution was mixed with 100 parts of the ferrite carrier particles (average volume diameter:50 μm) in the vacuum-deaerative coating apparatus at 60° C. for 30 minutes. The toluene was evaporated to produce the coating layer on the surface of the carrier particle. The carrier indicated $10^{7}$ Ωcm average volume resistivity.

Preparation for carrier D (Average volume resistivity:$10^{7}$ Ωcm)

The coating solution was prepared by mixing the following materials in a homo-mixer for ten minutes:

| | |
|---|---|
| Toluene | 14 parts |
| Styrene-methylmethacrylate copolymer (Copolymerization ratio 20:80) | 1 part |

Carbon black (mixture of 8 volume percent of the Vulcan XC-72 and 2 volume percent of the Regal 660R; Both of Cabot corp.) 10 volume percent to the copolymer Then the prepared coating solution was mixed with 100 parts of the ferrite carrier particles (average volume diameter:50 μm) in the vacuum-deaerative coating apparatus at 60° C. for 30 minutes. The toluene was evaporated to produce the coating layer on the surface of the carrier particle. The carrier indicated $10^{7}$ Ωcm average volume resistivity.

Preparation for carrier E (Average volume resistivity:$10^{5}$ Ωcm)

The coating solution was prepared by mixing the following materials in a homo-mixer for ten minutes:

| | |
|---|---|
| Toluene | 14 parts |
| Dimethylaminoethylmethacrylate-styrene-methylmethacrylate copolymer (Copolymerization ratio: 4:20:76) (Copolymerization ratio:4:20:76) | 1 part |

15 volume percent to the total amount of the mixed copolymer

Then the prepared coating solution was mixed with 100 parts of the ferrite carrier particles (average volume diameter:50 μm) in the vacuum-deaerative coating apparatus at 60° C. for 30 minutes. The toluene was evaporated to produce the coating layer on the surface of the carrier particle. The carrier indicated $10^{5}$ Ωcm average volume resistivity.

Preparation for carrier F (Average volume resistivity:$10^{5}$ Ωcm)

The coating solution was prepared by mixing the following materials in a homo-mixer for ten minutes:

| | |
|---|---|
| Toluene | 14 parts |
| Dimethylaminoethylmethacrylate-styrene-methylmethacrylate copolymer (Copolymerization ratio: 4:20:76) | 1 part |

Carbon black (coral X; Degussa Corp.) 12 volume percent to the total amount of the mixed copolymer Then the prepared coating solution was mixed with 100 parts of the ferrite carrier particles (average volume diameter:50 $\mu$m) in the vacuum-deaerative coating apparatus at 60° C. for 30 minutes. The toluene was evaporated to produce the coating layer on the surface of the carrier particle. The carrier indicated $10^5$ Ωcm average volume resistivity.

Figure 10:
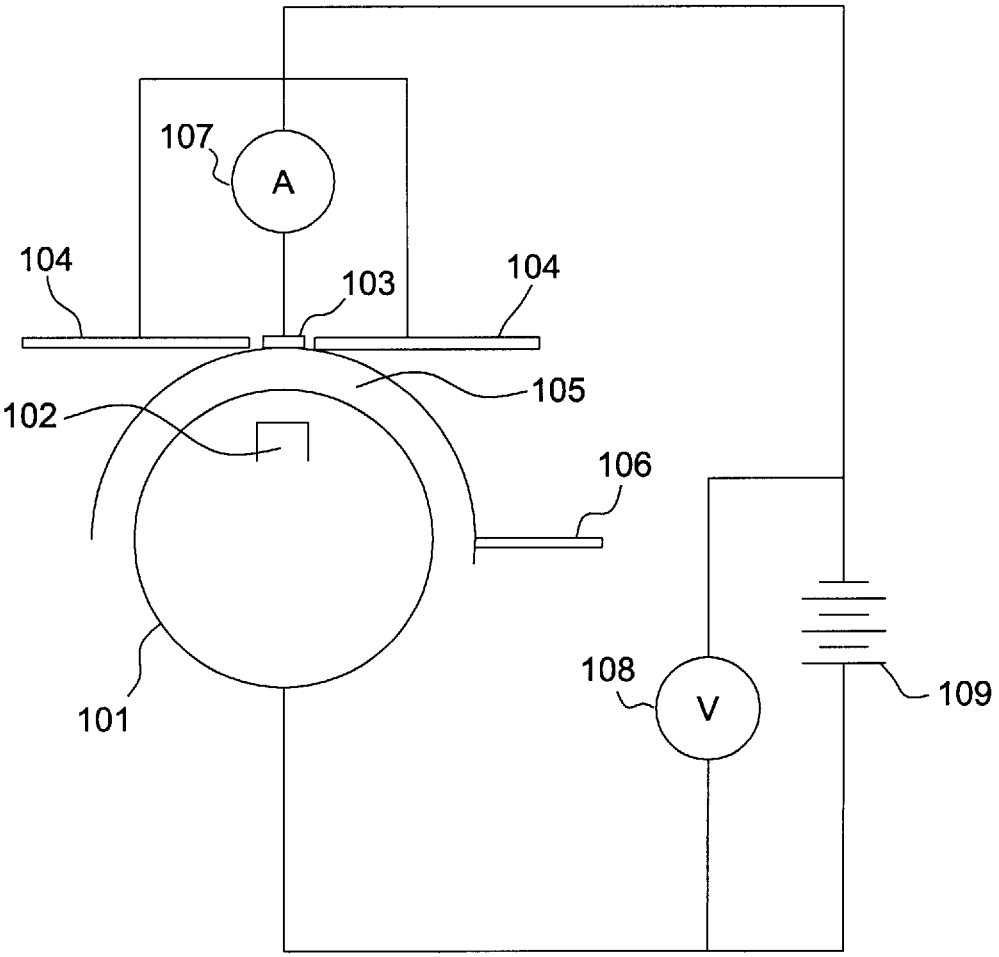
FIG. 10 is an explanatory view of the method of how to estimate the electric resistivity of the carrier particles.

The volume resistivity of the carrier particle was determined by the device disclosed in FIG. 10. The device comprises a rotatable cylinder 101, a fixed magnet 102 fixed within the rotatable cylinder, a cell 103 positioned adjacent to the fixed magnet, guard electrode 104, a blade 106 to restrict the layer thickness of the developer layer 105 formed on the surface of the cylinder 101, ampere meter 107, volt meter 108 and power source 109. By using this device, the value of the electric current flowed was measured by the ampere meter 107 when $10^6$ (V/m) of electric voltage was applied between the cell 103 and the cylinder 101. Then the volume resistivity of the carrier particle was determined from the magnitude of the electric current and the actual volume of the developer located at the portion between the cell and the cylinder. The actual dimension of the cell was set to 60 mm width for the longitudinal direction of the cylinder and 5 mm length for the circumference direction. The clearance between the cell and the cylinder was also set to 2.2 mm to have the developing layer on the cylinder contact the surface of the cell during the rotation of the cylinder without any coagulation of the developer therebetween.

In the following actual working examples, toner sets (Yellow, cyan, magenta, black) of A-color 635 (Color copier manufactured by Fuji Xerox Co., Ltd.) was used for the evaluation purpose.

EXAMPLE 1

Figure 11:
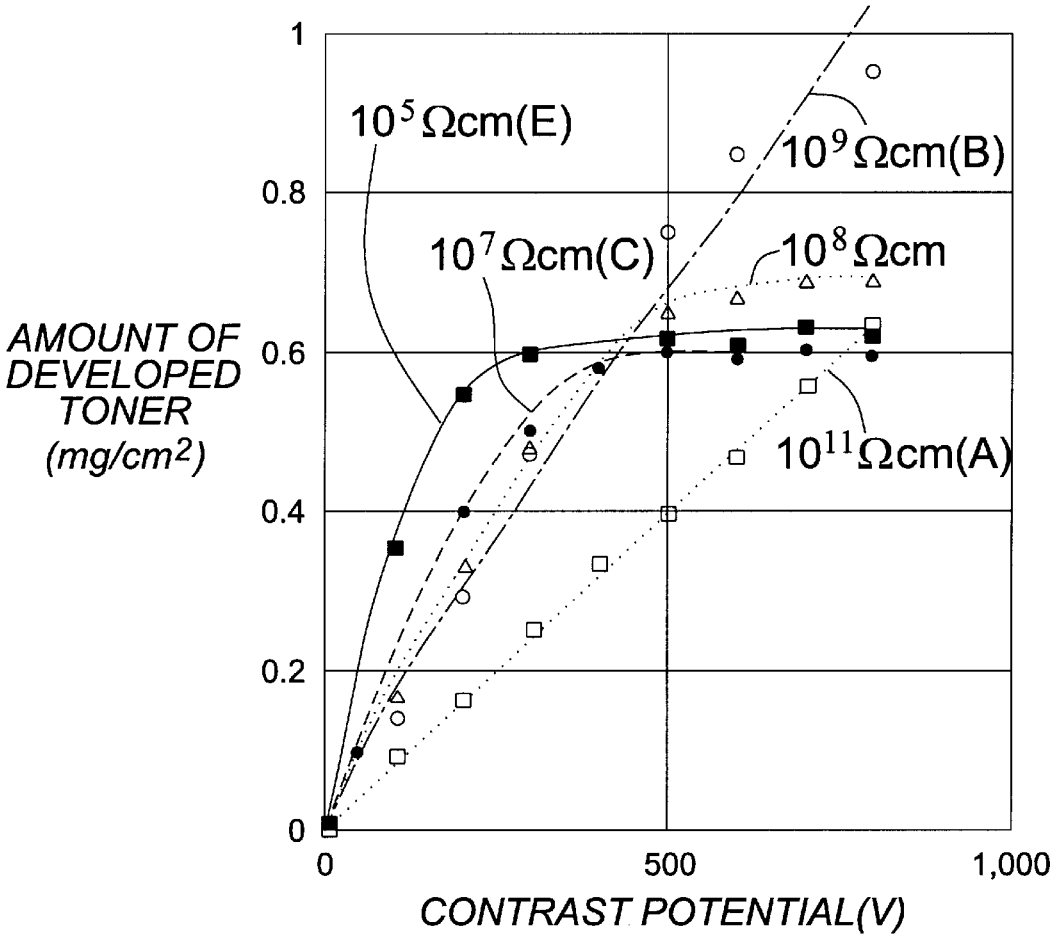
FIG. 11 is a graph showing the relationship between total amount of the developed toner and the developing contrast potential varied by the electric resistivity of the carrier particles.
Figure 12:
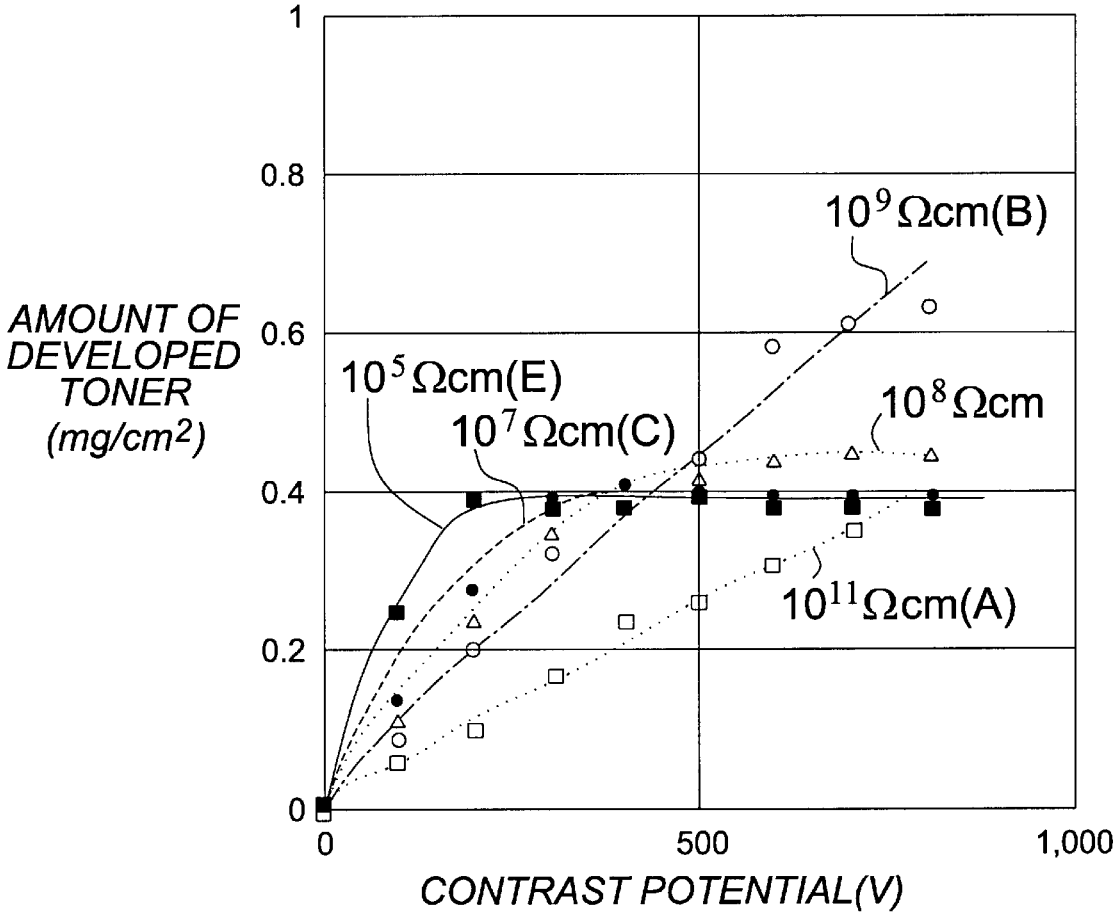
FIG. 12 is another graph showing the relationship between total amount of the developed toner and the developing contrast potential varied by the electric resistivity of the carrier particles.

Developing curves were determined by controlling the developing bias voltage and the exposure light for the image forming apparatus using several developing apparatuses, each of which has a developer containing carrier A, B, C, E and the bare ferrite carrier respectively, and the obtained developing curves for each developer are shown in FIG. 11 and FIG. 12. In this example, the toner concentration of the developer was set to 8 percent (FIG. 11 ) and 5 percent (FIG. 12) in constant, respectively. As indicated in FIG. 11 and FIG. 12, the developing curves indicate saturated characteristics when the average resistivity of the carrier particle was not more than $10^7$ Ωcm. On the contrary, the amount of the developing toner was continuously rising when the volume resistivity of the carrier particle was not less than $10^9$ Ωcm. The incline at the beginning of the developing curve tended to be high as the carrier resistivity was decreased. When the volume resistivity of the carrier particle is relatively low, the developing field will be maintained relatively high to make the incline at the beginning of the developing curve high. In this case, the internal electric field of the toner layer is also sufficiently low to remain the internal toner particles therein, therefore, the toner particles on the outer surface of the developer is once developed onto the electrostatic latent image, the developing amount of the toner particles is saturated thereafter. Otherwise, when the volume resistivity of the carrier particle is relatively high, the developing field will be maintained relatively low to make the incline at the beginning of the developing curve low. In this case, the internal electric field is sufficiently high to make the internal toner particles in the developing layer transfer to the electrostatic latent image, therefore, after the toner particles on the outer surface of the toner layer is developed onto the electrostatic latent image, the internal toner particles also tend to be transferred onto the electrostatic latent image (non-saturated). As the toner concentration was set to be lower in FIG. 12 to FIG. 11, the decline at the beginning of the developing curve of FIG. 12 was relatively low compared to that of FIG. 12 because, the low toner concentration made the triboelectric magnification of the toner particles high. The developing amount of the toner particles tended not to be saturated when the toner concentration was excessively low even if the carrier particle having relatively low volume resistivity was used at the disclosed range of the contrast potential in FIG. 11, and FIG. 12. However, by reducing the triboelectric magnification of the toner particles, the developing toner amount was able to be saturated in an actually used range of the contrast potential. It is also understood from FIG. 11 and FIG. 12 that if the contrast potential was varied within the saturated area of the developing curve, the total amount of the toner particles to be developed was virtually unchanged.

EXAMPLE 2

Figure 13:
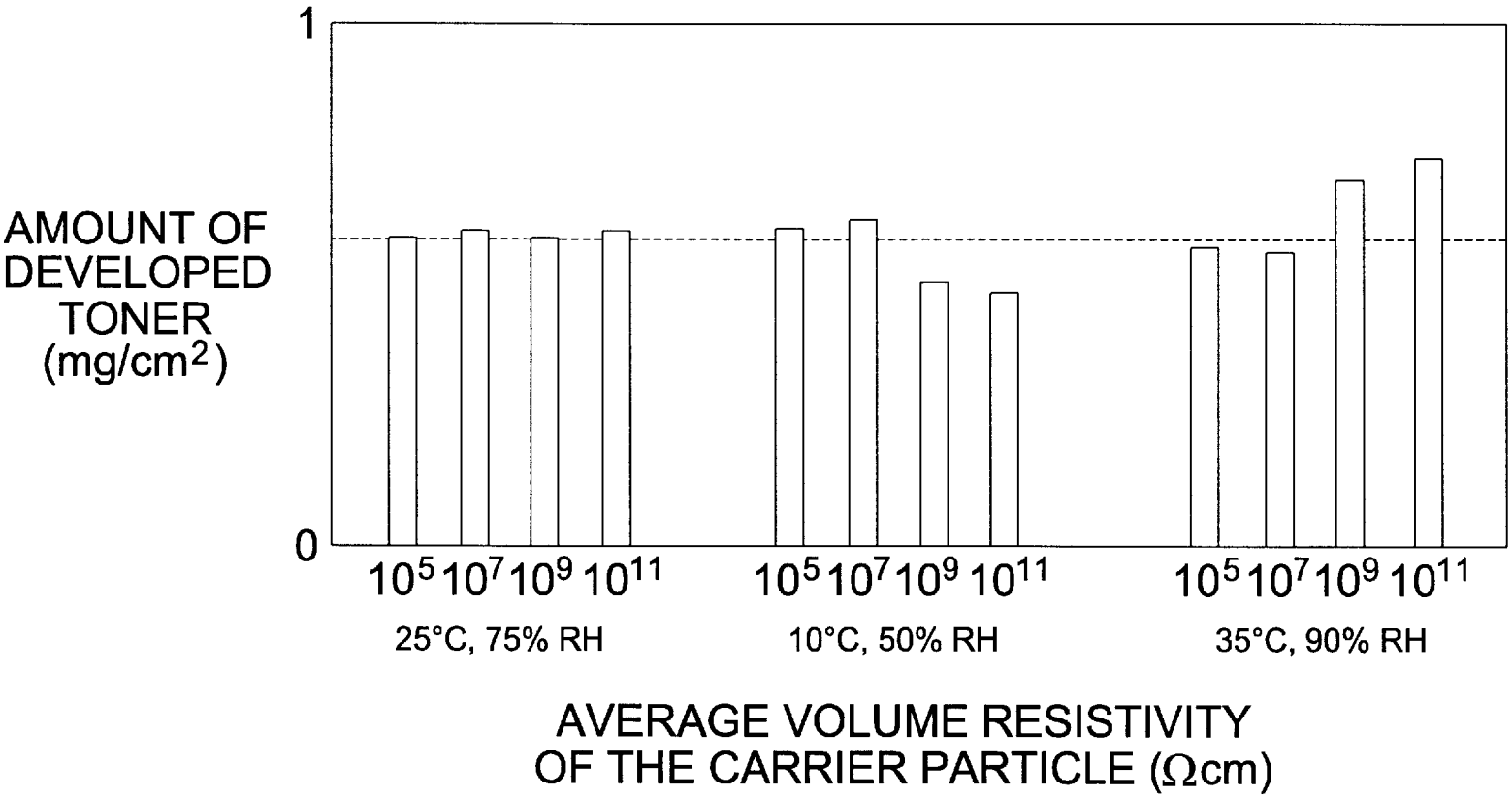
FIG. 13 is a graph showing the relationship between total amount of developed toner and the electric resistivity of the carrier varied by environmental condition such as temperature or humidity.

The same experiment as in example 1 was performed except for the changing of circumferential environments such as temperature and humidity. The result is indicated in FIG. 13. The developing amount of the toner particles was changed easily due to the changing of the circumferential condition when the carrier particles having not less than $10^9$ Ωcm were used. However, the developing amount of the toner particles was not easily changed when the carrier particles having relatively low volume resistivity were used at the saturated area in the developing curve regardless of the condition changing of the environment.

EXAMPLE 3

The same experiments were performed by changing the photoconductive drum to a photoconductive drum X which had a uniform sensitivity within its entire surface, to a photoconductive drum Y which had an uneven sensitivity along its circumference direction within its entire surface, and to a photoconductive drum Z which had an uneven sensitivity along its rotating axis. The plural sets of developers were prepared by mixing the aforementioned carrier particles A to F with yellow toner, cyan toner and magenta toner and loaded independently into each developing apparatus for the rotatable developing apparatus disclosed in FIG. 6. Then a flesh-colored image was produced by the image forming apparatus. During the developing process using the carrier particle which had $10^5$ Ωcm average volume resistivity, the latent image on the photoreceptor was developed at the saturated portion of the developing curve such that the developing amount of the toner particle would be constant by controlling the toner concentration of the developer and contrast potential defined by the surface potential of the photoreceptor and the bias voltage for the developing apparatus. During the developing process using the carrier particle which had $10^9$ Ωcm average volume resistivity, the toner concentration was set the same as that of the developing process mentioned above and the developing amount of the toner was controlled to be constant by controlling the contrast potential. The solid image corresponding to the entire surface area of the photoconductive drum was formed thereon and the color unevenness of the solid image was visually examined by a person. The result is indicated in table 1. It is understood from table. 1 that the color unevenness on the photoreceptor was detected due to the non-uniform sensitivity of the photoconductive drum in the case that the carrier particles having $10^9$ Ωcm was used and the linear developing curve was applied to the developing process. However, no color unevenness on the photoreceptor was detected in the case that the carrier particles having $10^5$ Ωcm was used and the saturated developing curve was applied to the developing process. In this case, stable halftone-image reproducibility was obtained corresponding to the change of the contrast potential.

TABLE 1

| | Color unevenness of the developed solid image on the following photoreceptor | | |
|---|---|---|---|
| | Photoreceptor X | Photoreceptor Y | Photoreceptor Z |
| Saturated developing ($10^5$ Ωcm carrier) | Not detected | Not detected | Not detected |
| Non-saturated developing ($10^9$ Ωcm carrier) | Not detected | Visually detected | Visually detected |

EXAMPLE 4

Figure 14:
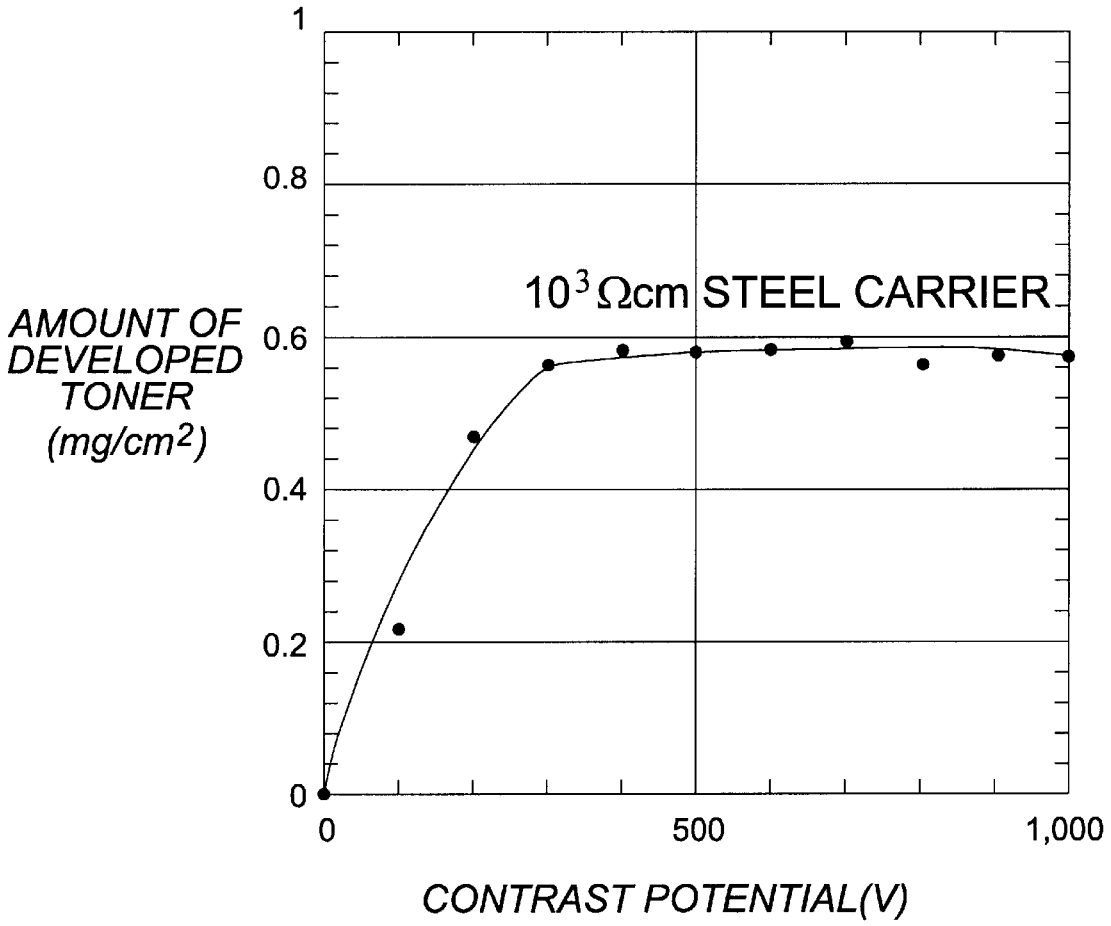
FIG. 14 is still another graph showing the relationship between total amount of the developed toner and the developing contrast potential.

The same experiment as in Example 1 was performed by using the steel carrier beads having $10^3$ Ωcm average volume resistivity. The result is indicated in FIG. 14.

EXAMPLE 5

When a DC+AC superimposed developing bias voltage was applied to the aforementioned developing process which indicated the saturated characteristic, the "white spots" on the transferred image due to a carrier transfer onto the photoreceptor from the developing roller occurred when the peak to peak voltage (Vp-p) of the AC bias voltage was not more than 100 Volt or the frequency (f) of the AC bias voltage was not less than 20 KHz. In addition, when the Vp-p was less than 500 volt, a dielectric breakdown also occurred. When the frequency (f) was less than 400 Hz, image blurring also occurred. The results were indicated in the table 2.

TABLE 2

| Vp-p of the Developing Bias (V) | 100 | 200 | 300 | 400 | 500 | 600 |
|---|---|---|---|---|---|---|
| frequency of the Developing bias (Hz) | Detected defects | | | | | |
| 100 | IB | IB | IB | IB | IB | DB |
| 200 | IB | IB | IB | IB | IB | DB |
| 400 | None | None | None | None | None | DB |
| 800 | None | None | None | None | None | DB |
| 1.5K | None | None | None | None | None | DB |
| 3.0K | None | None | None | None | None | DB |
| 5.0K | None | None | None | None | None | DB |
| 10K | None | None | None | None | None | DB |
| 15K | None | None | None | None | None | DB |
| 20K | None | None | None | None | None | DB |
| 25K | WS | WS | WS | WS | WS | DB |
| 30K | WS | WS | WS | WS | WS | DB |

IB: Image Blur,
DB: Dielectric Breakdown,
None: Not Occurred,
WS: White Spots

EXAMPLE 6

Various kinds of carrier particles were prepared by coating a resin material the same as Carrier A onto the various ferrite core particles and steel core particles, each of which has unique average particle diameter as indicated in table 3. The total amount of the coating material on the core particle was set to be 10 weight percent to the ferrite core particles having 50 μm average diameter. For other carrier particles, the coating was formed so that the amount of the coated material per unit area of the core particle would be the same amount as that of the carrier having 50 μm average diameter. The results obtained by the developing process using those carrier particles varied by changing the kind of magnets located in the developing roller are indicated in Table 3. The obtained developing curves were determined whether the developing curve substantially indicated the saturated characteristic or not by determining whether the specific range, which was 1/10 width of the total contrast potential to be necessary to figure out the developing curve, indicating a rate of increase of the developing toner less than 10 percent was substantially present or not.

TABLE 3

| Average Diameter of the carrier | Fixed Magnet On the pole (AC*/DC) | | Fixed magnet Inter-poles (AC/DC) | | Fixed Repulsive On the Pole (DC Only) | | Rotatable (DC Only) | |
|---|---|---|---|---|---|---|---|---|
| (μm) | F** | S*** | F | S | F | S | F | S |
| | (Existing of the saturated Portion on the developing curve) | | | | | | | |
| 20 | Y/Y | Y/Y | Y/Y | Y/Y | N | Y | N | Y |
| 30 | Y/Y | Y/Y | Y/Y | Y/Y | N | Y | N | Y |
| 35 | Y/Y | Y/Y | Y/Y | Y/Y | N | Y | N | Y |
| 40 | Y/Y | Y/Y | Y/Y | Y/Y | N | Y | N | Y |
| 50 | N/N | Y/Y | Y/Y | Y/Y | N | N | N | N |
| 60 | N/N | — | Y/Y | — | N | — | N | — |
| 65 | — | N/N | — | Y/Y | — | N | — | N |
| 80 | N/N | — | N/N | — | N | — | N | — |
| 90 | — | N/N | — | Y/Y | — | N | — | N |
| 100 | N/N | — | N/N | — | N | — | N | — |
| 115 | — | N/N | — | N/N | — | N | — | N |
| 130 | N/N | — | N/N | — | N | — | N | — |

F: Ferrite carrier,
S; Steel carrier;
AC: AC bias applied;
DC: DC bias applied;
On the Pole: the developing nip was located on the magnetic pole;
Inter-poles: the developing nip was located on the inter-magnetic poles;
Repulsive: the configuration of the magnet at the developing nip was a repulsive one.;
*: Vp-p = 400 V;
**: the magnetizing at the 400 Ös was 35 emu/g;
***: the magnetizing at the 400 Ös was 45 emu/g;
Y: The saturated characteristic was detected;
N: The saturated characteristic was not detected It is understood from the table 3 that the saturated characteristic of the developing curve would not be relatively obtained when the rotating magnet configuration or the repulsive configuration of the magnet was used. When the fixed magnet with on-the-pole developing configuration was adopted, the saturated characteristic of the developing curve was observed when the ferrite carrier having not more than 40 μm average diameter was used, and when the steel carrier having not more than 50 μm average diameter was used respectively. When the fixed magnet with inter-poles developing configuration was adopted, the saturated characteristic of the developing curve was observed when the ferrite carrier having average diameter of not more than 60 μm was used, and when the steel carrier having not more than 90 μm of average diameter was used, respectively. The differences on the diameter between the ferrite carrier and the steel carrier might have occurred because the magnetizing of the steel carrier was much higher than that of the ferrite carrier and the developer would be pressed much stronger to the developing roller when the inter-poles configuration was adopted sufficient to reduce the spaces among carrier particles.

The occurrence of "white spots" due to the transferring of the carrier particles from the developing roller to the photoreceptor was frequent when the magnetic carrier having not more than 45 emu/g at the magnetic field of 400 Ös magnetizing was used. However, once the magnetizing exceeded 80 emu/g, the thickness of the developing layer on the developing roller tended to be uneven. Therefore, preferably, the magnetizing of the carrier particle is from 45 to 80 emu/g at the magnetic field of 400 Ös.

EXAMPLE 7

Both of the on-the-pole developing and the inter-poles developing process were performed by using the ferrite carrier having 108 Ωcm of average volume resistivity. The results are indicated in Table 4

TABLE 4

| Carrier diameter | Fixed magnets On-the-Pole (AC Bias*/DC Bias) | | Fixed magnets Inter-Poles (AC bias/DC Bias) | |
|---|---|---|---|---|
| (μm) | d = 0.5 mm | d = 1.2 mm | d = 0.5 mm | d = 1.2 mm |
| | (Existing of the saturated Portion on the developing curve) | | | |
| 20 | Y/Y | Y/Y | Y/Y | Y/Y |
| 30 | Y/Y | Y/Y | Y/Y | Y/Y |
| 35 | Y/Y | Y/Y | Y/Y | Y/Y |
| 40 | Y/Y | Y/Y | Y/Y | Y/Y |
| 50 | Y/Y | Y/Y | Y/Y | Y/Y |
| 60 | Y/Y | Y/Y | Y/Y | Y/Y |
| 80 | Y/Y | N/N | Y/Y | Y/Y |
| 100 | N/N | N/N | Y/Y | Y/Y |
| 130 | N/N | N/N | Y/Y | Y/Y |

d: distance between the developing roller and the photoreceptor;
Y: The saturated characteristic was detected;
N: The saturated characteristic was not detected.

It is understood that the saturated characteristic of the developing curve was always obtained when the carrier particles having average volume resistivity of $10^8$ Ωcm were used with the on-the-pole configuration of the fixed magnet regardless of the carrier diameter or the developing parameter such as developing clearance.

EXAMPLE 8

The developing process using the same carrier as Example 7 was performed by changing the relative rotating direction and speed between the photoreceptor and the developing roller. The result is indicated in table 5. The phenomena that the increased image density only at the front portion or at the end portion corresponding to the moving direction of the solid image, was visually detected. According to the result, the moving direction of the photoreceptor and the developing roller is preferably the same direction at the developing nip. Also, the moving ratio of the surface of the developing roller to the surface of the photoreceptor is preferably not more than 1.8. Also, if the moving ratio is less than 0.8, the image quality will be decreased. Therefore, the moving ratio is preferably set to from 0.8 to 1.8.

TABLE 5

| | Moving direction at the developing nip | |
|---|---|---|
| Moving ratio | Same direction | Opposite direction |
| 0.5 | FLD | FHD |
| 0.6 | N | FHD |
| 0.7 | N | FHD |
| 0.8 | N | FHD |
| 0.9 | N | FHD |
| 1.0 | N | FHD |
| 1.1 | N | FHD |
| 1.2 | N | FHD |
| 1.3 | N | FHD |
| 1.4 | N | FHD |
| 1.5 | N | FHD |
| 1.6 | N | FHD |
| 1.7 | N | FHD |
| 1.8 | N | FHD |
| 2.0 | BLD | FHD |
| 2.5 | BHD | FHD |

FLD: Front side lightly high density;
FHD: Front side highly high density;
N: No density unevenness occurred;
BLD: Back side lightly high density;
BHD: Back side highly high density.

EXAMPLE 9

Figure 15:
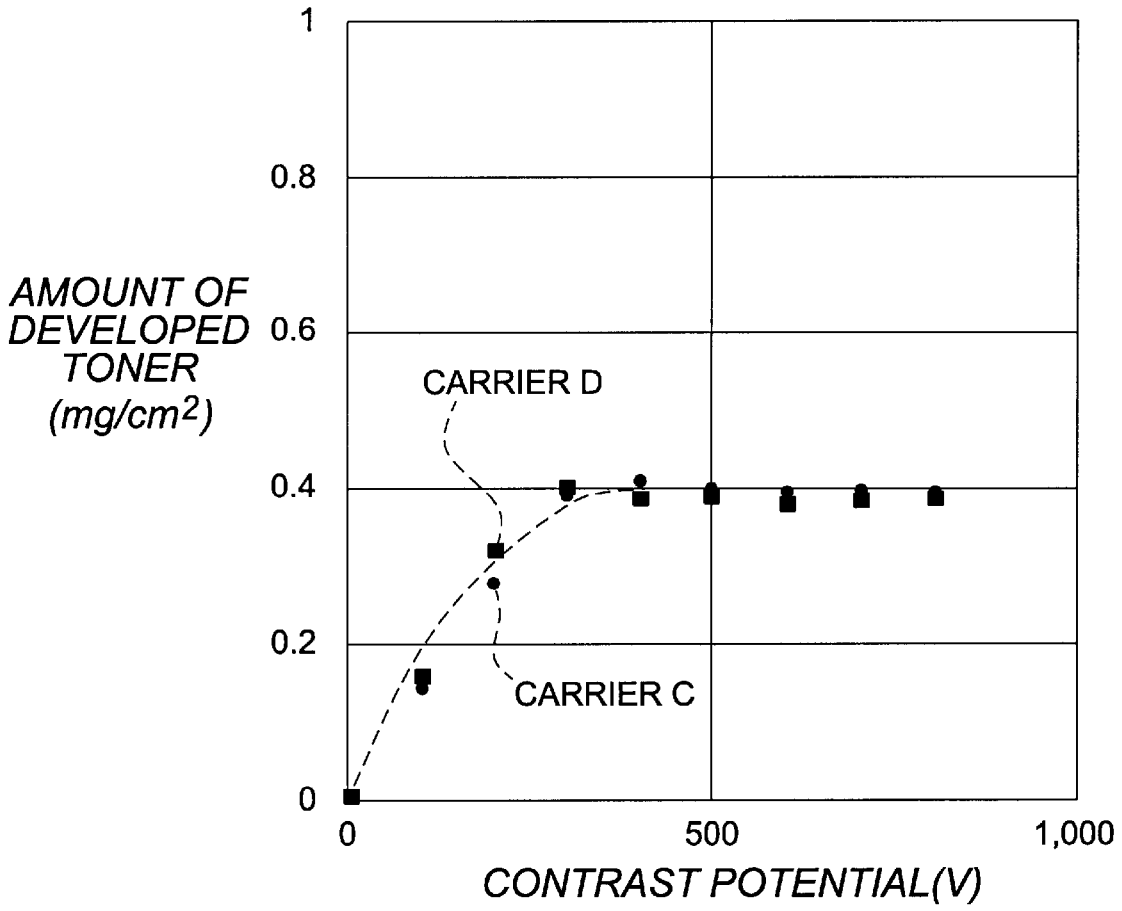
FIG. 15 is yet another graph showing the relationship between total amount of the developed toner and the developing contrast potential.
Figure 16:
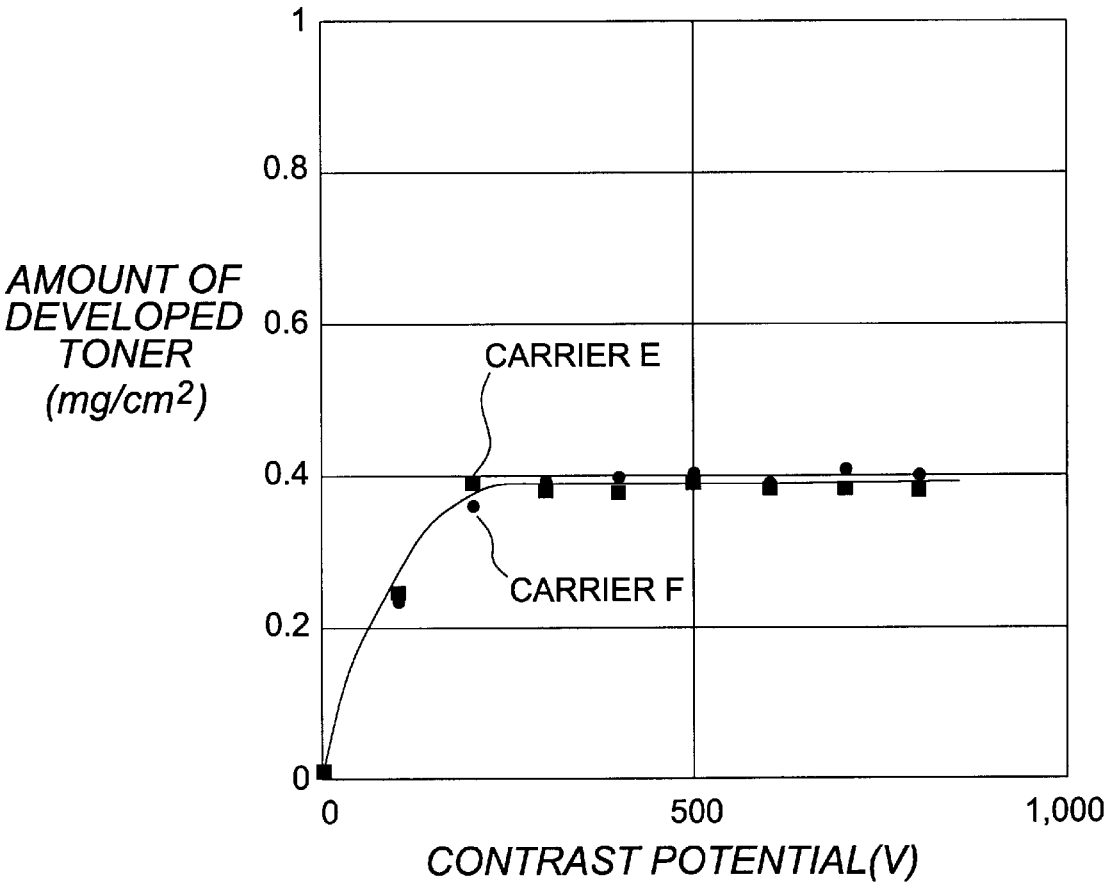
FIG. 16 is still further another graph showing the relationship between total amount of the developed toner and the developing contrast potential.

The developing curves of the carriers C and D, and carriers E and F are obtained corresponding to the contrast potential. Carriers C and D have almost the same average volume resistivity. Carriers E and F have almost the same average volume resistivity. The obtained developing curves are indicated in FIG. 15, and FIG. 16, respectively. It is understood that If the average volume resistivity of the carrier particles is not too high, the saturated characteristic was always obtained regardless of the difference of the carrier materials.

In this example, a toner having 7 μm of average particle diameter was used for evaluation purpose. The saturated characteristic of the developer mainly depends on the characteristics of the carrier particles, such as average volume resistivity, sticking characteristics or the like. Therefore, the changing of the toner particle would not be highly affected to the above results.

We claim:

1. An image forming apparatus for forming a digitized image comprising:

a photoreceptor having a surface;

an electrostatic image forming device for forming an electrostatic latent image on said surface of the photoreceptor, said electrostatic latent image being a digitally-reproduced binary latent image;

a developing device for developing said electrostatic latent image, said developing device including a two-component developer including magnetic carrier particles and toner particles;

a bias applying device for applying a bias voltage between the developing device and the photoreceptor for defining a contrast potential of the digitally-reproduced binary latent image to be developed; and said developing system including a control system for controlling a certain amount of toner to be developed to be substantially constant corresponding to said contrast potential, wherein said control system includes a setting of an average volume resistivity of said magnetic carrier particles from $10^3$ Ωcm to $10^8$ Ωcm.

2. An image forming apparatus as set forth in claim 1, wherein said magnetic carrier particles comprise a coated surface comprising resin material and conductive material.

3. An image forming apparatus as set forth in claim 2, wherein said conductive material is conductive particles dispersed in the resin material.

4. An image forming apparatus for forming a digitized image comprising:

a photoreceptor having a surface;

an electrostatic image forming device for forming an electrostatic latent image on said surface of the photoreceptor, said electrostatic latent image being a digitally-reproduced binary latent image;

a developing device for developing said electrostatic latent image, said developing device including a two-component developer including magnetic carrier particles and toner particles;

a bias applying device for applying a bias voltage between the developing device and the photoreceptor for defining a contrast potential of the digitally-reproduced binary latent image to be developed; and said developing system including a control system for controlling a certain amount of toner to be developed to be substantially constant corresponding to said contrast potential, wherein said bias applying device applies a DC voltage overlapped with an AC voltage having a peak to peak voltage (Vp-p) which is not less than 100V and not more than 500V, and a frequency not less than 400 Hz and not more than 20 KHz.

5. An image forming apparatus for forming a digitized image comprising:

a photoreceptor having a surface;

an electrostatic image forming device for forming an electrostatic latent image on said surface of the photoreceptor, said electrostatic latent image being a digitally-reproduced binary latent image;

a developing device for developing said electrostatic latent image, said developing device including a two-component developer including magnetic carrier particles and toner particles;

a bias applying device for applying a bias voltage between the developing device and the photoreceptor for defining a contrast potential of the digitally-reproduced binary latent image to be developed; and said developing system including a control system for controlling a certain amount of toner to be developed to be substantially constant corresponding to said contrast potential, wherein said control system comprises a setting of said developing device for including a rotatable hollow cylinder for holding the two-component developer thereon and a fixed magnet located within the hollow cylinder, said magnet comprising a plural magnetic poles along an inner circumference of the hollow cylinder, and said control system further comprises a setting of average volume diameter of the carrier particles not more than 40 μm.

6. An image forming apparatus for forming a digitized image comprising:

a photoreceptor having a surface;

an electrostatic image forming device for forming an electrostatic latent image on said surface of the photoreceptor, said electrostatic latent image being a digitally-reproduced binary latent image;

a developing device for developing said electrostatic latent image, said developing device including a two-component developer including magnetic carrier particles and toner particles;

a bias applying device for applying a bias voltage between the developing device and the photoreceptor for defining a contrast potential of the digitally-reproduced binary latent image to be developed; and said developing system including a control system for controlling a certain amount of toner to be developed to be substantially constant corresponding to said contrast potential, wherein said control system comprises a setting of said developing device for including a rotatable hollow cylinder for holding the two-component developer thereon and a fixed magnet located within the hollow cylinder, said magnet comprising a plural magnetic poles arranged alternatively about their polarity along an inner circumference of the hollow cylinder, said hollow cylinder and said photoreceptor defining a developing nip therebetween and any of said magnetic poles are shifted from the developing nip, and said control system further comprises a setting of average volume diameter of the carrier particles not more than 60 μm.

7. An image forming apparatus for forming a digitized image comprising:

a photoreceptor having a surface;

an electrostatic image forming device for forming an electrostatic latent image on said surface of the photoreceptor, said electrostatic latent image being a digitally-reproduced binary latent image;

a developing device for developing said electrostatic latent image, said developing device including a two-component developer including magnetic carrier particles and toner particles;

a bias applying device for applying a bias voltage between the developing device and the photoreceptor for defining a contrast potential of the digitally-reproduced binary latent image to be developed; and said developing system including a control system for controlling a certain amount of toner to be developed to be substantially constant corresponding to said contrast potential, wherein said control system comprises a setting of said developing device for including a rotatable hollow cylinder for holding the two-component developer thereon and a fixed magnet located within the hollow cylinder, said magnet comprising a plural magnetic poles along an inner circumference of the hollow cylinder, and said control system further comprises a setting of magnetizing of the magnetic carrier particles not less than 45 emu/g at the magnetic field of 400 Ös and a setting of an average particle diameter of said magnetic carrier not more than 50 μm.

8. An image forming apparatus for forming a digitized image comprising:

a photoreceptor having a surface;

an electrostatic image forming device for forming an electrostatic latent image on said surface of the photoreceptor, said electrostatic latent image being a digitally-reproduced binary latent image;

a developing device for developing said electrostatic latent image, said developing device including a two-component developer including magnetic carrier particles and toner particles;

a bias applying device for applying a bias voltage between the developing device and the photoreceptor for defining a contrast potential of the digitally-reproduced binary latent image to be developed; and said developing system including a control system for controlling a certain amount of toner to be developed to be substantially constant corresponding to said contrast potential, wherein said control system comprises a setting of said developing device for including a rotatable hollow cylinder for holding the two-component developer thereon and a fixed magnet located within the hollow cylinder, said magnet comprising a plural magnetic poles arranged alternatively about their polarity along an inner circumference of the hollow cylinder, said hollow cylinder and said photoreceptor defining a developing nip therebetween and any of said magnetic poles are shifted from the developing nip, and said control system further comprises a setting of magnetizing of the magnetic carrier particles not less than 45 emu/g at the magnetic field of 400 Ös and a setting of an average particle diameter of said magnetic carrier not more than 90 $\mu$m.

9. An image forming apparatus for forming a digitized image comprising:

a photoreceptor having a surface;

an electrostatic image forming device for forming an electrostatic latent image on said surface of the photoreceptor, said electrostatic latent image being a digitally-reproduced binary latent image;

a developing device for developing said electrostatic latent image, said developing device including a two-component developer including magnetic carrier particles and toner particles;

a bias applying device for applying a bias voltage between the developing device and the photoreceptor for defining a contrast potential of the digitally-reproduced binary latent image to be developed; and said developing system including a control system for controlling a certain amount of toner to be developed to be substantially constant corresponding to said contrast potential, wherein said control system comprises a setting of said developing device for including a developer holding member for transporting said two-component developer thereon in a direction the same as a moving direction of the surface of the photoreceptor at a developing nip defined by the developer holding member and the photoreceptor, and a setting of moving speed ratio of the two-component developer to the surface of the photoreceptor at the developing nip not less than 0.8 and not more than 1.8.

* * * * *